US006028554A

United States Patent [19]

Mandai et al.

[11] Patent Number: 6,028,554

[45] Date of Patent: Feb. 22, 2000

[54] MOBILE IMAGE APPARATUS AND AN ANTENNA APPARATUS USED FOR THE MOBILE IMAGE APPARATUS

[75] Inventors: Harufumi Mandai, Takatsuki; Teruhisa Tsuru, Kameoka; Toshifumi Oida, Omihachiman, all of Japan

[73] Assignee: Murata Manufacturing Co., Ltd., Japan

[21] Appl. No.: 09/035,522

[22] Filed: Mar. 5, 1998

[30] Foreign Application Priority Data

| | | | |
|---|---|---|---|
| Mar. 5, 1997 | [JP] | Japan | 9-050521 |
| Mar. 18, 1997 | [JP] | Japan | 9-064317 |
| May 13, 1997 | [JP] | Japan | 9-122102 |

[51] Int. Cl.[7] ..... H01Q 1/38

[52] U.S. Cl. ..... 343/700 MS; 343/702; 343/752; 343/872; 343/895

[58] Field of Search ..... 343/700 MS, 702, 343/872, 853, 745, 749, 752, 829, 846, 895

[56] References Cited

U.S. PATENT DOCUMENTS

| | | | |
|---|---|---|---|
| 3,417,403 | 12/1968 | Fenwick | 343/895 |
| 3,573,840 | 4/1971 | Gouilou et al. | 343/895 |
| 4,679,051 | 7/1987 | Yabu et al. | 343/700 MS |
| 4,728,962 | 3/1988 | Kitsuda et al. | 343/872 |
| 5,892,482 | 4/1999 | Coleman et al. | 343/700 MS |

FOREIGN PATENT DOCUMENTS

| | | |
|---|---|---|
| 0749214 | 12/1996 | European Pat. Off. . |
| 0759646 | 2/1997 | European Pat. Off. . |
| 0762538 | 3/1997 | European Pat. Off. . |
| 0777293 | 6/1997 | European Pat. Off. . |
| 0814536 | 12/1997 | European Pat. Off. . |
| 0831546 | 3/1998 | European Pat. Off. . |
| 9638882 | 12/1996 | WIPO . |

OTHER PUBLICATIONS

Patent Abstracts of Japan, vol. 17, No. 695 Dec. 20, 1993 & JP 05 236397 A (Matsushita Electric Works), Sep. 10, 1993 *Abstract* .

*Primary Examiner*—Don Wong
*Assistant Examiner*—Tho Phan
*Attorney, Agent, or Firm*—Ostrolenk, Faber, Gerb & Soffen, LLP

[57] ABSTRACT

The invention provides a mobile image apparatus (10), comprising: a case unit (11); at least one antenna (12) disposed at least one of within said case unit (11) and outside said case unit (11); wherein said chip antenna (12) comprises; a substrate (1) made of at least one of a dielectric material and a magnetic material; at least one conductor (2) disposed at least one of within said substrate (1) and on a surface of said substrate (1); at least one power feeding terminal (3) disposed on a surface of said substrate (1) and connected to one end of said conductor (2) for applying a voltage to said conductor (2).

21 Claims, 17 Drawing Sheets

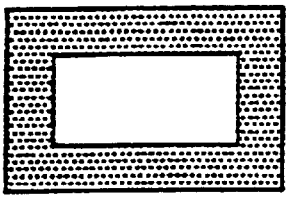
FIG. 16(a)
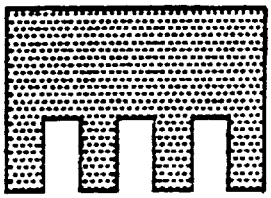
FIG. 16(b)
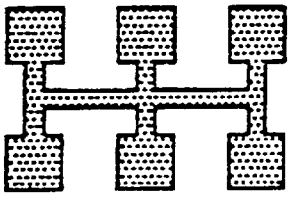
FIG. 16(c)
FIG. 17
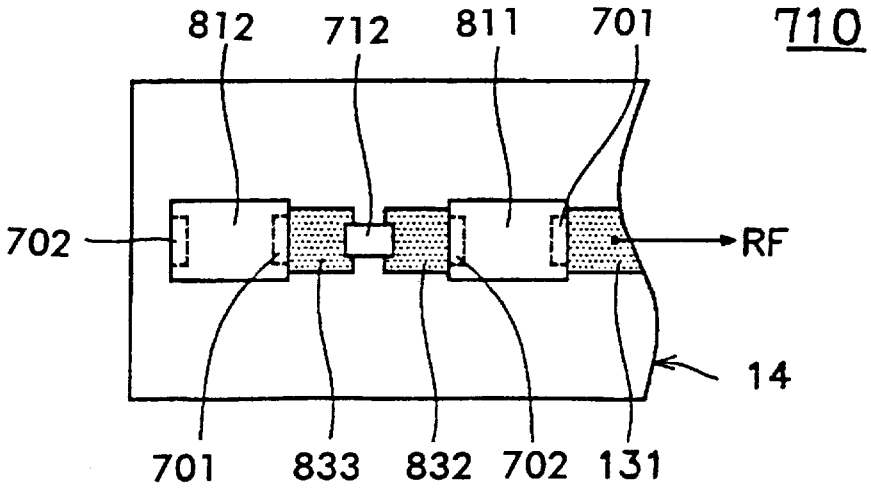

MOBILE IMAGE APPARATUS AND AN ANTENNA APPARATUS USED FOR THE MOBILE IMAGE APPARATUS

BACKGROUND OF THE INVENTION

1. Field of the Invention

The present invention relates to a mobile image apparatus such as a liquid-crystal television and a portable video apparatus, and more particularly, to a mobile image apparatus having an antenna disposed at least one of within said case unit and outside said case unit. The present invention also relates to an antenna apparatus associated with the above described mobile image apparatus.

2. Related Art of the Invention

FIG. 28 illustrates a conventional mobile image apparatus. A mobile image apparatus 450 has a case unit 451, an antenna 452 connected to the case unit 451, and an image display unit 453 for displaying radio waves carried on the antenna 452 as a video image.

Generally, the antenna 452 is an elastic monopole antenna, and is formed by, as shown in FIG. 29, mounting a radiation device 455 having a length of ¼ λ (λ: the wavelength at a resonant frequency) on a ground, for example, a case unit. One end of the radiation device 455 serves as a power supply section 456 connected to a power supply source V, while the other end of the radiation device 455 serves as an open end 457. When the antenna 452 is pulled out for use, the radiation device 455 is extended to be about ¼ λ.

However, the above known type of mobile image apparatus presents the following problem. The length of the radiation device while the receiving operation is performed is λ/4, the radiation device is extended to be approximately 60 cm Accordingly, the mobile image apparatus is unstable and falls or bends even with a small impact. Thus, the mobile image apparatus is dangerous and difficult to use.

SUMMARY OF THE INVENTION

Accordingly, in order to overcome the above problem, it is an object of the present invention to provide a stable mobile image apparatus in which an antenna does not project from a casing unit even while a receiving operation is performed. And, it is another object of the present invention to provide a small antenna apparatus that does not protrude from the case body of the portable video apparatus even during reception.

The present invention provides a mobile image apparatus, comprising: a case unit; at least one antenna disposed at least one of within said case unit and outside said case unit; wherein said chip antenna comprises; a substrate made of at least one of a dielectric material and a magnetic material; at least one conductor disposed at least one of within said substrate and on a surface of said substrate; at least one power feeding terminal disposed on a surface of said substrate and connected to one end of said conductor for applying a voltage to said conductor.

According to the above described mobile image apparatus, a chip antenna having a conductor at least in one area of a dielectric or magnetic substrate, i.e., on a surface of the substrate or within the substrate, is used, thereby decreasing the propagation velocity and shortening the wavelength. Accordingly, when the relative dielectric constant of the substrate is indicated by, the effective line length increases by a factor of $\epsilon^{1/2}$, i.e., the effective line length of the chip antenna is longer than that of a conventionally used rod antenna. Consequently, if the effective line length of the chip antenna is set the same as that of a conventionally used rod antenna, the size of the chip antenna is much smaller than that of the rod antenna, thereby making it possible to easily integrate the antenna into the case unit. As a result, the antenna does not project from the case unit even while the receiving operation is performed. And, even if the chip antenna is disposed outside the case unit, the problems described above would not occur.

In the above described mobile image apparatus, said chip antenna may further comprise at least one free terminal disposed on a surface of said substrate and connected to the other end of said conductor.

In the above described mobile image apparatus, an extra antenna may be connected to one of said power feeding terminal and said free terminal.

According to the above described mobile image apparatus, an extra antenna is connected to the power feeding terminal or the free terminal of one of the chip antennas, thereby easily increasing the lengths if the conductors provided for the antennas. It is thus possible to receive with high sensitivity a lower frequency band in which a longer conductor is required In the above described mobile image apparatus, a plurality of said chip antennas are provided. Said antennas may be connected to each other, and may be provided in accordance with receiving frequencies. Further, said plurality of chip antennas may be connected in series by connecting their respective free terminals to power feeding terminals.

According to the above described mobile image apparatus, the antenna apparatus possesses a plurality of resonance frequencies, and a wider band of the antenna apparatus can be realized. Therefore, an antenna apparatus smaller than the conventional monopole antenna is capable of receiving the VHF band and the UHF band. It is thus possible to obtain a stable mobile image apparatus.

In the above described mobile image apparatus, at least one variable capacitance element may be connected to said free terminal of the chip antenna. One of said variable capacitance elements may be connected to said free terminal of the chip antenna at the final stage of said plurality of chip antennas which are connected to each other in series.

According to the mobile image apparatus, by varying the capacitance value of the variable capacitance element, the capacitance components of the antenna element can be varied. Therefore, only the lowest resonance frequency can be moved without moving the other resonance frequencies. As a result, since the antenna apparatus is capable of receiving a lower frequency range, the portable video apparatus in which the antenna apparatus is mounted is capable of receiving a lower frequency range.

In the above described mobile image apparatus, a radiation conductor may be connected to said free terminal of the chip antenna at the final stage.

Since a radiation conductor functions as a part of the antenna apparatus, the radiation area of the antenna apparatus is increased. Therefore, even if the chip antenna is formed into a smaller size, the gain of the antenna apparatus can be maintained without being decreased.

In the above described mobile image apparatus, a capacitance element may be connected between at least one of the connection points of said free terminal and said power feeding terminal, and a ground.

Since a capacitance element is connected between the connection point of the free terminal and the power feeding terminal, and a ground, the resonance frequency of the antenna apparatus can be moved to low frequencies, and as a result, the band of the antenna apparatus can be moved to low frequencies. Therefore, by controlling the capacitance value of the capacitance element, the receiving band of the antenna apparatus can be varied to a desired band.

In the above described mobile image apparatus, a switching element may be connected in series to said capacitance element.

Since a switching element is connected between the capacitance element and the ground, by turning on/off the switching element, the band of the antenna apparatus can be moved. Therefore, it becomes possible for one antenna apparatus to be provided with a plurality of bands, and as a result, a portable video apparatus in which this one small antenna apparatus is mounted becomes capable of receiving a signal of a wide range of frequencies at a sensitivity equal to that of the conventional monopole antenna.

In the above described mobile image apparatus, a coaxial cable may be connected to the power feeding terminal of the chip antenna at the first stage of said plurality of chip antennas which are connected to each other in series.

Since a coaxial cable is connected to the power feeding terminal of the chip antenna at the first stage of the Plurality of chip antennas which are connected in series, when a digital noise is generated from the portable video apparatus in which the antenna apparatus is mounted, a shielded coaxial cable cuts off the digital noise. Therefore, it is possible to prevent the antenna apparatus from receiving digital noise from the portable video apparatus in which the antenna apparatus is mounted.

In the above described mobile image apparatus, said chip antenna further comprise a trimming electrode disposed at least one of within said substrate and on a surface of said substrate and connected to the other end of said conductor. Said trimming electrode may be covered by a resin layer.

Since a trimming electrode connected to the other end of a conductor is provided, a capacitive coupling is formed between the trimming electrode and each of the conductor and a ground of a mobile communication unit on which the chip antenna is mounted. Accordingly, by adjusting the area of the trimming electrode, the amount of the capacitive coupling can be adjustable, thereby making it possible to adjust the resonant frequency of the chip antenna. As a result, the resonant frequency is easily adjustable in the manufacturing process of the chip antenna, thereby improving the yield of the chip antenna.

Since the trimming electrode is coated with a resin layer, the environment-resistance and characteristics are improved and further the reliability of the chip antenna is enhanced.

In the above described mobile image apparatus, said substrate may be formed by laminating a plurality of layers together, the layers each having a major surface; and said trimming electrode may be disposed on one of the major surfaces of said layers.

In the above described mobile image apparatus, said substrate may be formed by laminating a plurality of layers together, the layers each having a major surface and the substrate having a laminating direction normal to the major surface; and said conductor may be spiral shaped and having a spiral axis disposed perpendicular to the laminating direction of said substrate.

In the above described mobile image apparatus, said conductor may be formed in a plane on one of a surface of the substrate in a meander shape.

The present invention further provides an antenna apparatus, comprising: a plurality of chip antennas connected to each other and having a different resonance frequency respectively, each of said chip antennas comprising: a substrate made of at least one of a dielectric material and a magnetic material; at least one conductor disposed at least one of within said substrate and on a surface of said substrate; at least one power feeding terminal disposed on a surface of said substrate and connected to one end of said conductor for applying a voltage to said conductor; and at least one free terminal disposed on a surface of said substrate and connected to the other end of said conductor.

In the above described antenna apparatus, said plurality of chip antennas may be connected in series by connecting their respective free terminals to power feeding terminals.

In the above described antenna apparatus, at least one variable capacitance element may be connected to said free terminal of the chip antenna. One of said variable capacitance elements may be connected to said free terminal of the chip antenna at the final stage of said plurality of chip antennas which are connected co each other in series.

In the above described antenna apparatus, a radiation conductor may be connected to said free terminal of the chip antenna at the final stage.

In the above described antenna apparatus, a capacitance element may be connected between at least one of the connection points of said free terminal and said power feeding terminal, and a ground.

in the above described antenna apparatus, a switching element may be connected in series to said capacitance element.

In the above described antenna apparatus, a coaxial cable may be connected to the power feeding terminal of the chip antenna at the first stage of said plurality of chip antennas which are connected to each other in series.

BRIEF DESCRIPTION OF THE DRAWINGS

FIGS. 16(*a*) is a top view illustrating an internally hollowed-out shape as an example of a modification made to the trimming electrode.

FIGS. 16(*b*) is a top view illustrating a comb-like shape as an example of a modification made to the trimming electrode.

FIGS. 16(*c*) is a top view illustrating a group-like shape as an example of a modification made to the trimming electrode.

FIG. 17 is a partial top plan view of a sixth embodiment of an antenna apparatus of the present invention.

PREFERRED EMBODIMENT OF THE PRESENT INVENTION

Other features and advantages of the present invention will become apparent from the following description of preferred embodiments of the invention which refers to the accompanying drawings.

Figure 1:
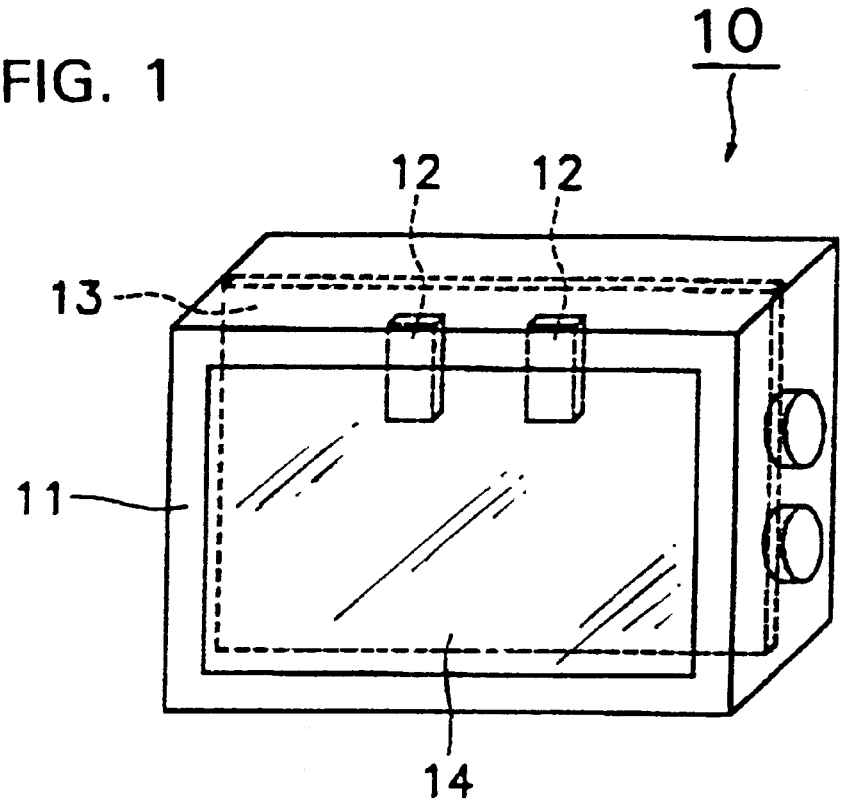
FIG. 1 is a perspective view illustrating a first embodiment of a mobile image apparatus of the present invention.

FIG. 1 is a perspective view illustrating a first embodiment of a mobile image apparatus of the present invention. A mobile image apparatus 10 is formed of a case unit 11, chip antennas 12, 12 built into the case unit 11, a mounting board 13 on which the chip antennas 12, 12 are mounted, and an image display unit 14 for displaying radio waves carried on the chip antennas 12, 12 as an image. It should be noted that the circuit on the mounting board is not shown in FIG. 1.

Figure 2:
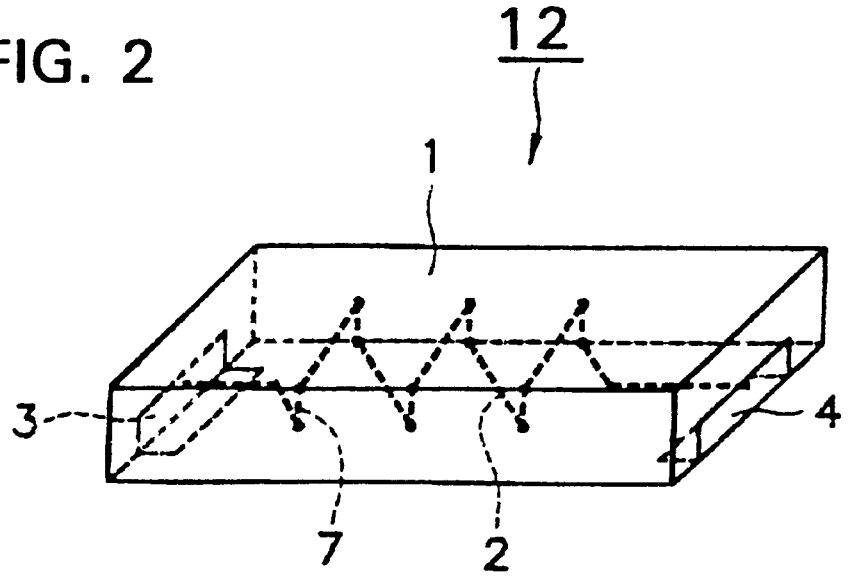
FIG. 2 is a perspective view illustrating a chip antenna forming the mobile image device shown in FIG. 1.
Figure 3:
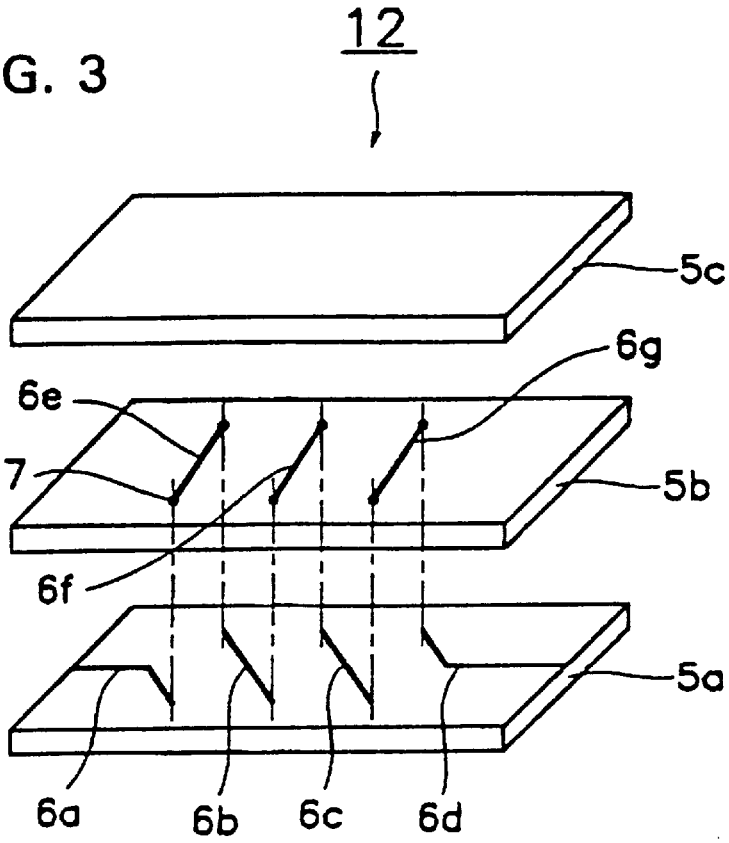
FIG. 3 is an exploded perspective view illustrating the chip antenna shown in FIG. 2.

FIGS. 2 and 3 are respectively a perspective view and an exploded perspective view of the chip antenna shown in FIG. 1. The chip antenna 12 has a conductor 2, a power feeding terminal 3, and a free terminal 4. The conductor 2 is spirally wound within a rectangular-prism substrate 1 in the longitudinal direction of the substrate 1. The power feeding terminal 3 is formed over surfaces of the substrate 1 in order to apply a voltage to the conductor 2 and is connected to one end of the conductor 2. The free terminal 4 is connected to the other end of the conductor 2.

The substrate 1 formed by laminating rectangular sheet layers 5*a* through 5*c* made of a dielectric material (relative dielectric constant: approximately 6.1) essentially consisting of barium oxide, aluminum oxide, and silica. Provided on the surfaces of the sheet layers 5*a* and 5*b* by means such as printing, vapor-depositing, laminating, or plating are conductor patterns 6*a* through 6*g* which are linearly formed or generally formed in an L shape and are made of copper or a copper alloy. Moreover, via-holes 7 are provided at predetermined positions (both ends of each of the conductor patterns 6*e* through 6*g*) on the sheet layer 5*b* through the thickness of the sheet layer 5*b*.

Then, the sheet layers 5*a* through 5*c* are laminated and sintered, and the conductor patterns 6*a* through 6*h* are connected through the via-holes 7, thereby forming the conductor 2 spirally wound within the substrate 1 in the longitudinal direction of the substrate 1 and having a rectangular shape in winding cross section.

One end (one end of the conductor pattern 6*a*) of the conductor 2 is led to the surface of the substrate 1 and is connected to the power feeding terminal 3 provided over the surfaces of the substrate 1 in order to apply a voltage to the conductor 2. The other end (one end of the conductor pattern 6*d*) of the conductor 2 is also led to the surface of the substrate 1 and is connected to the free terminal 4.

Figure 4:
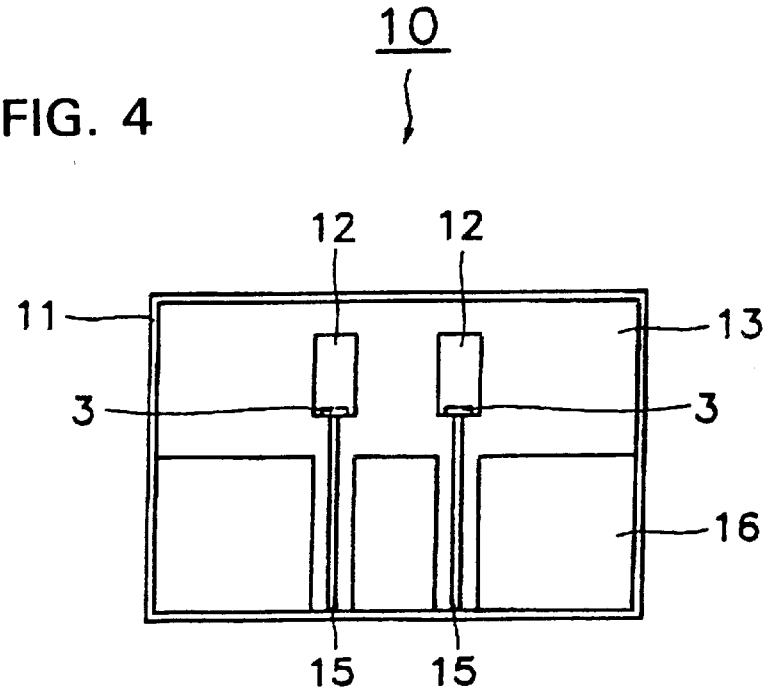
FIG. 4 is a front view illustrating the inner portion of the mobile image apparatus shown in FIG. 1.

FIG. 4 is a front view illustrating the inner portion of the mobile image apparatus 10 from which the image display unit 13 is removed in order to explain in detail how the chip antennas 12 are integrated into the case unit. The chip antennas 12, 12 are mounted on the mounting board 13 which is made of a glass epoxy resin and is provided with transmission lines 15, 15 and a ground electrode 16. In this state, the power feeding terminals 3, 3 are each connected to one end of each of the transmission lines 15, 15. The other ends of the transmission lines 15, 15 are connected to a high-frequency circuit (not shown) formed on the reverse surface of the mounting board 13. The ground electrode 16 is connected to a ground, for example, the case unit 11 of the mobile image apparatus 10.

One of the chip antennas 12, 12 is used for the VHF band (30 MHz to 300 MHz) having a smaller receiving frequency band, while the other antenna 12 is used for the UHF band (300 MHz to 3 GHz) having a larger receiving frequency band.

Figure 5:
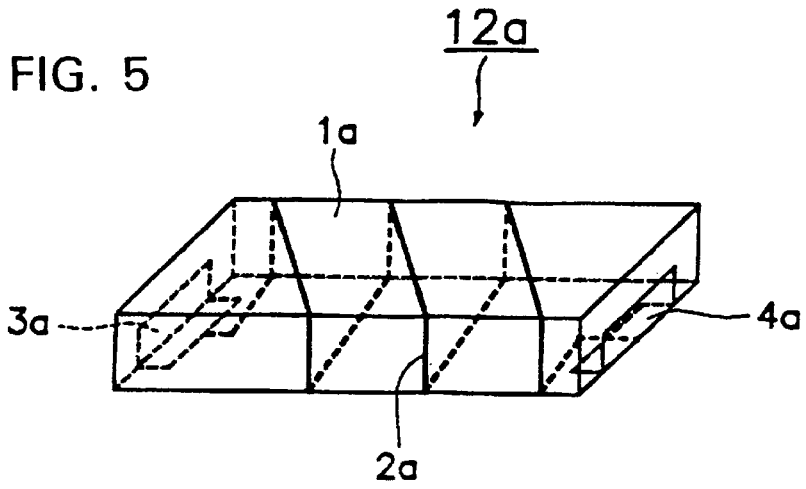
FIG. 5 is a perspective view illustrating an example of modifications made to the chip antenna shown in FIG. 2.
Figure 6:
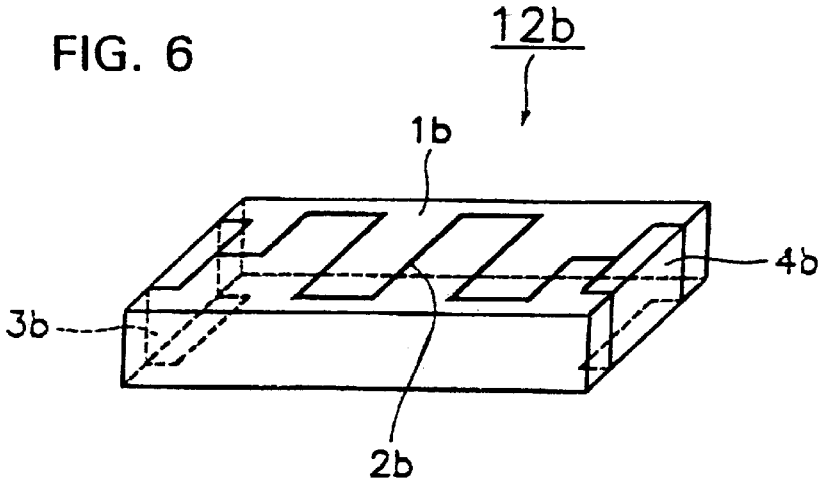
FIG. 6 is a perspective view illustrating another example of modifications made to the chip antenna shown in FIG. 2.

FIGS. 5 and 6 are perspective views illustrating examples of modifications made to the chip antenna shown in FIG. 2. A chip antenna 12*a* shown in FIG. 5 has a rectangular-prism substrate 1*a*, a conductor 2*a*, a power feeding terminal 3*a*, and a free terminal 4*a*. The conductor 2*a* is spirally wound along the surfaces of the substrate 1*a* in the longitudinal direction of the substrate 1*a*. The power feeding terminal 3*a* is formed over surfaces of the substrate 1*a* in order to apply a voltage to the conductor 2*a* and is connected to one end of the conductor 2*a*. The free terminal 4*a* is formed over surfaces of the substrate 1*a* and is connected to the other end of the conductor 2*a*. In this modification, it is easy to form the conductor 2*a* spirally on the surfaces of the substrate 1*a* by means such as screen-printing, thereby simplifying the manufacturing process of the chip antenna 12*a*.

A chip antenna 12*b* shown in FIG. 6 is formed of a rectangular-prism substrate 1*b*, a conductor 2*b* formed in a meandering shape on a surface (one main surface) of the substrate 1*b*, a power feeding terminal 3*b*, and a free terminal 4*b*. The power feeding terminal 3*b* is provided over surfaces of the substrate 1*b* in order to apply a voltage to the conductor 2*b* and is connected to one end of the conductor 2*b*. The free terminal 4*b* is formed over surfaces of the substrate 1*b* and is connected to the other end of the conductor 2*b*. In this modification, since the meandering conductor 2*b* is formed only on one main surface of the substrate 1*b*, the height of the substrate 1*b* is reduced, thereby making it possible to decrease the height of the chip antenna 12*b*. It should be noted that the meandering conductor 2*b* may be provided within the substrate 1*b*.

According to the mobile image apparatus of the foregoing first embodiment, two chip antennas, which are allocated to the VHF band and the UHF band, respectively, whose frequency bands greatly differ from each other, are built into the case unit. Consequently, unlike conventionally used antennas, the size of the antenna is not required to be increased, thereby obtaining a stable mobile image apparatus.

Figure 7:
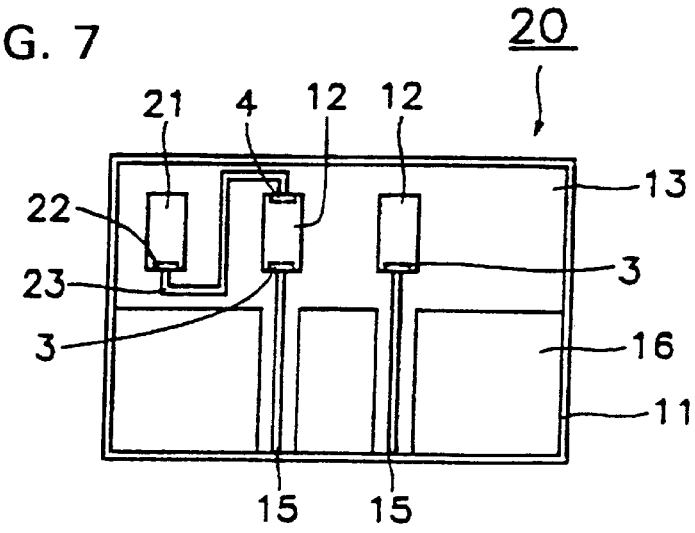
FIG. 7 is a front view illustrating the inner portion of a second embodiment of a mobile image apparatus of the present invention.

FIG. 7 is a front view illustrating the inner portion of a second embodiment of a mobile image apparatus of the present invention. A mobile image apparatus 20 differs from the mobile image apparatus 10 of the first embodiment in that another chip antenna 21 is connected in series to one of the chip antennas 12. Namely, a free terminal 4 of the chip antenna 12 is connected to a power feeding terminal 22 of the chip antenna 21 via a transmission line 23. It should be noted that the chip antenna 21 is constructed similarly to the chip antenna 12 (FIG. 2).

According to the mobile image apparatus of the above-described second embodiment, two chip antennas are connected in series to each other, thereby easily increasing the lengths of the conductors. It is thus possible to perform the receiving operation with high sensitivity even in the VHF band, in other words, in a lower frequency band in which a longer conductor is required.

The VHF band having a center frequency of 150 MHz was received by using chip antennas having dimensions of 8 mm×5 mm×2 mm connected in series to each other and by using a conventionally used rod antenna having a length of 75 cm. Moreover, the UHF band having a center frequency of 800 MHz was received by using one chip antenna having dimensions of 8 mm×5 mm×2 mm and by using a conventionally used rod antenna having a length of 75 cm. The above-described examples show that there was very little difference in the gain in all the channels between this embodiment and known mobile image apparatuses. Thus, it has been proved that the mobile image apparatuses of the foregoing embodiments can be sufficiently put into practical use.

In the foregoing first and second embodiments, the VHF band is received by one chip antenna or two series-connected chip antennas, while the UHF band is received by one chip antenna. However, the VHF band and the UHF band may be more precisely divided into a greater number of bands, and a plurality of antennas allocated to the respective bands may be switched by a switch or a duplexer, thereby achieving the receiving operation with even higher sensitivity by the built-in chip antennas.

Moreover, according to the mobile image apparatus of the second embodiment, an extra chip antenna is connected in series to the chip antenna provided in the apparatus. However, a linear antenna or a rod antenna may be connected to the chip antenna, in which case, advantages similar to those exhibited by the provision of an extra chip antenna may be offered. Additionally, since at least one chip antenna is connected, the length of the linear antenna or the rod antenna is not required to be increased which has been conventionally required. Namely, a linear antenna or a rod antenna having a length of about 20 cm is merely connected to the chip antenna, thereby obtaining the gain equivalent to that of a conventionally used 75 cm-rod antenna.

Further, in the foregoing embodiments, the substrate of the chip antenna made of a dielectric material essentially consisting of barium oxide, aluminum oxide, and silica is used. However, the substrate is not limited to the above type of dielectric material and may be made of a dielectric material essentially consisting of titanium oxide and neodymium oxide, a magnetic material essentially consisting of nickel, cobalt, and iron, or a combination of a dielectric material and a magnetic material.

Additionally, although only one conductor is provided for a chip antenna, a plurality of conductors positioned in parallel to each other may be provided. In this case, the resulting chip antenna has a plurality of resonant frequencies in accordance with the number of conductors, and it is possible to cope with multi bands by using only one chip antenna or one antenna unit.

Figure 8:
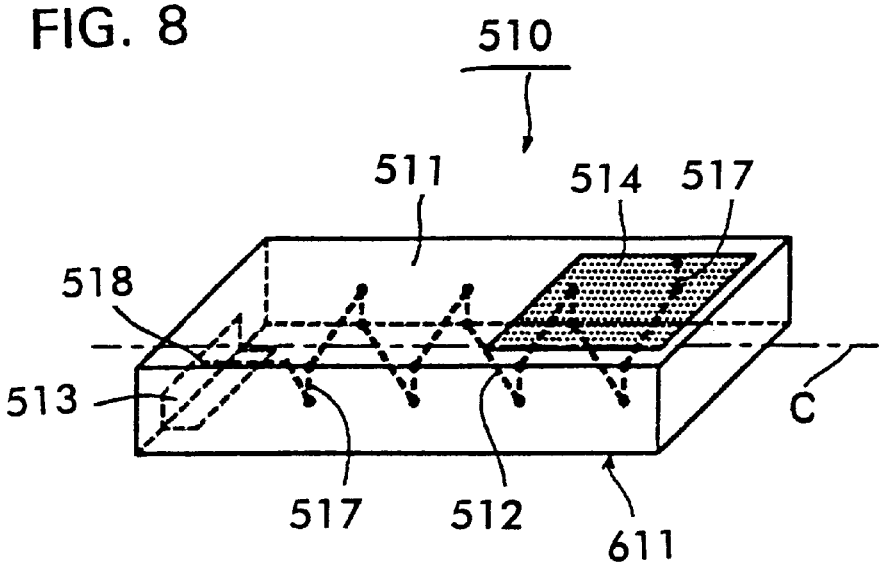
FIG. 8 is a perspective view illustrating a third embodiment of a chip antenna of the present invention.
Figure 9:
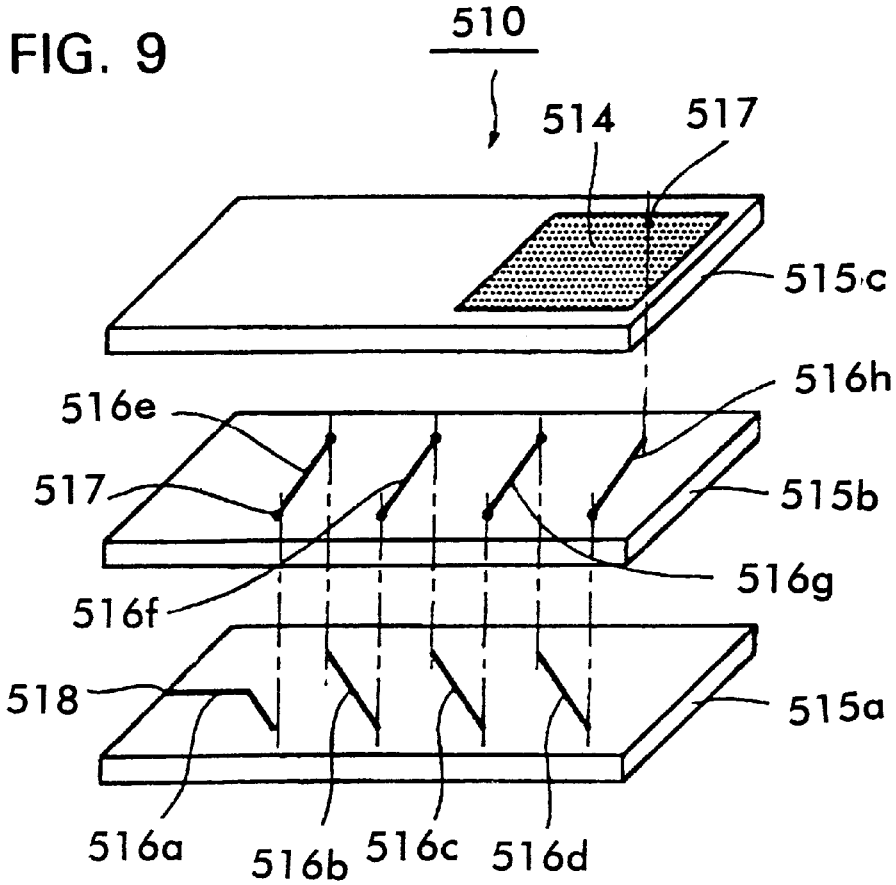
FIG. 9 is an exploded perspective view illustrating the chip antenna shown in FIG. 8.

FIGS. 8 and 9 are respectively a perspective view and an exploded perspective view illustrating a third embodiment of a chip antenna of the present invention. A chip antenna 510 is formed of a rectangular-prism substrate 511 having a mounting surface 611, a conductor 512, a power feeding terminal 513, and a trimming electrode 514 formed generally in the shape of a rectangle and provided on the surface of the substrate 511. The conductor 512 is spirally wound within the substrate 511, the winding axis C being positioned in the direction parallel to the mounting surface 611, i.e., in the longitudinal direction of the substrate 511. The power feeding terminal 513 is formed over surfaces of the substrate 511 in order to apply a voltage to the conductor 512. The conductor 512 is connected at one end to the power feeding terminal 513 and at the other end to the trimming electrode 514. With this configuration, a capacitive coupling is generated between the trimming electrode 514 and a ground (not shown) of a mobile communication unit on which the chip antenna 510 is mounted, and between the trimming electrode 514 and the conductor 512.

The substrate 511 is formed by laminating rectangular sheet layers 515*a* through 515*c* made of a dielectric material (relative magnetic permeability: approximately 6.1) essentially consisting of barium oxide, aluminum oxide, and silica. Conductor patterns 516*a* through 516*h* formed in a straight line or generally an L shape and made of copper or a copper alloy are provided on the surfaces of the sheet layers 515*a* and 515*b* by means such as printing, vapor-depositing, laminating, or plating. Formed on the sheet layer 515*c* by means such as printing, vapor-depositing, laminating, or plating is the trimming electrode 514 generally formed in a rectangle and made of copper or a copper alloy. Further, via-holes 517 are provided at predetermined positions (at both ends of each of the conductor patterns 516*e* through 516*g* and one end of the conductor pattern 516*h*) on the sheet layer 515*b* and at a predetermined position (the vicinity of one end of the trimming electrode 514 On the sheet layer 515*c*.

Then, the sheet layers 515*a* through 515*c* are laminated and sintered, and the conductor patterns 516*a* through 516*h* are connected through the via-holes 517, thereby forming the conductor 512 having a rectangular shape in winding cross section and spirally wound within the substrate 511 in the longitudinal direction of the substrate 511. Further, the trimming electrode 514 generally formed in a rectangle is formed on the surface of the substrate 511.

One end of the conductor 512 (one end of the conductor pattern 516*a*) is led to the surface of the substrate 511 so as to form a power supply section 518 and is connected to the power feeding terminal 513 which is provided over the surfaces of the substrate 511 to apply a voltage to the conductor 512. The other end of the conductor 512 (one end of the conductor pattern 516*h*) is connected to the trimming electrode 514 through the via-hole 517 within the substrate 511.

Figure 10:
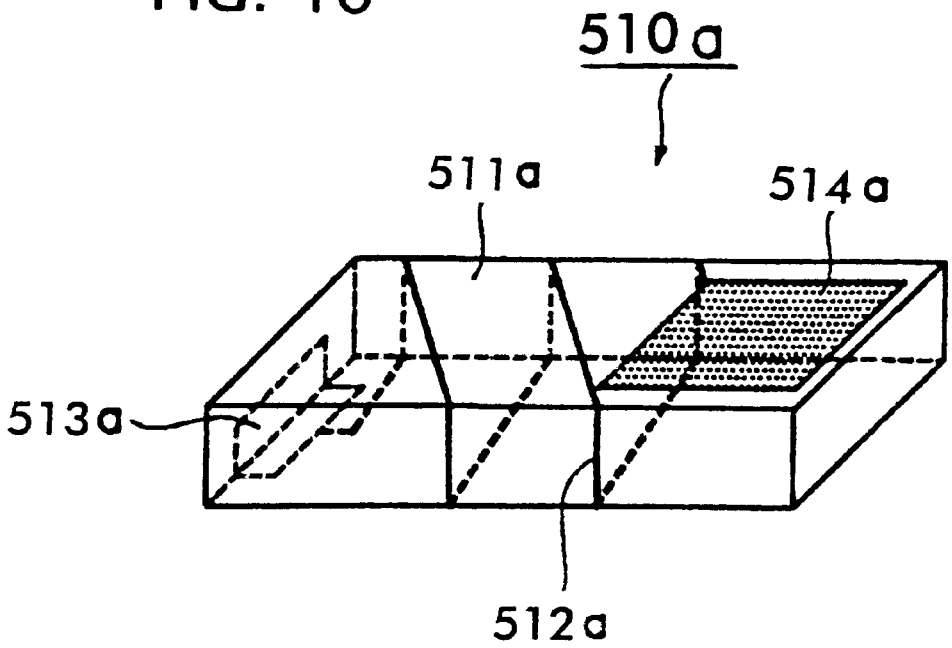
FIG. 10 is a perspective view illustrating an example of modifications made to the chip antenna shown in FIG. 8.
Figure 11:
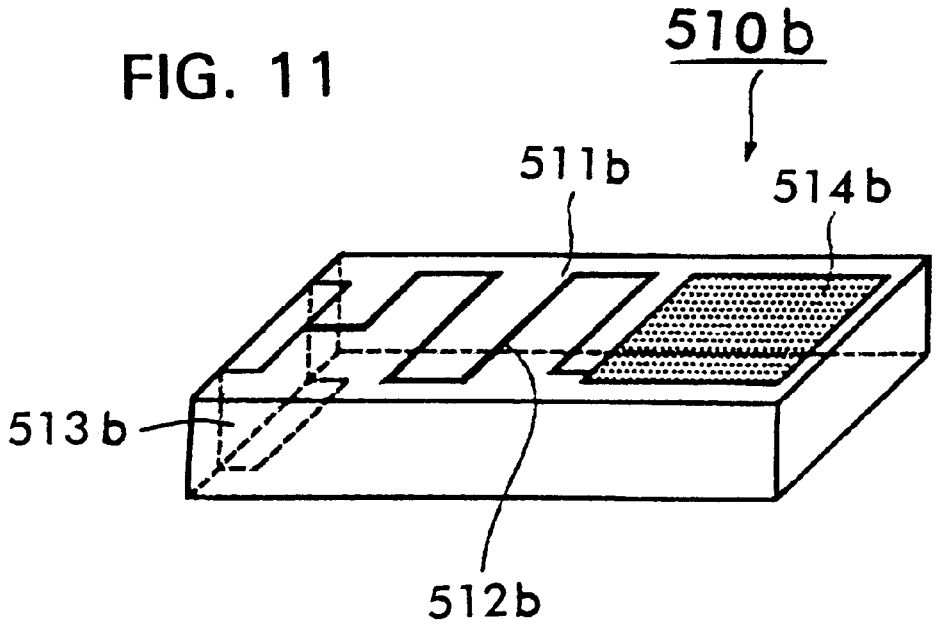
FIG. 11 is a perspective view illustrating another example of modifications made to the chip antenna shown in FIG. 8.

FIGS. 10 and 11 are respectively perspective views illustrating examples of modifications made to the chip antenna shown in FIG. 8. A chip antenna 510*a* shown in FIG. 10 is formed of a rectangular-prism substrate 511*a*, a conductor 512*a*, a power feeding terminal 513*a*, and a trimming electrode 514*a* generally formed in the shape of a rectangle. The conductor 512*a* is spirally wound along the surfaces of the substrate 511 in the longitudinal direction of the substrate 511. The power feeding terminal 513*a* is provided over the surfaces of the substrate 511 in order to apply a voltage to the conductor 512*a* and is connected to one end of the conductor 512*a*. The trimming electrode 514*a* generally formed in a rectangle is provided within the substrate 511 and is connected to the other end of the conductor 512*a*. With the above configuration, a capacitive coupling is formed between the trimming electrode 514*a* and a ground (not shown, of a mobile communication unit on which the chip antenna 510*a* is mounted, and between the trimming electrode 514 and the conductor 512*a*. In this modification, the conductor is easy to spirally form on the surfaces of a substrate by means such as screen printing, thereby simplifying the manufacturing process of the chip antenna.

A chip antenna 510*b* shown in FIG. 11 is formed of a rectangular prism substrate 511*b*, a meandering conductor 512*b* formed on the surface (one main surface) of the substrate 511*b*, a power feeding terminal 513*b*, and a trimming electrode 514*b* formed generally in a rectangle. The power feeding terminal 513*b* is disposed over the surfaces of the substrate 511*b* in order to apply a voltage to the conductor 512*b* and is connected to one end of the conductor 512*b*. The trimming electrode 514*b* is formed on the surface of the substrate 511*b* and is connected to the other end of the conductor 512*b*. With the above configuration, a capacitor element is formed between the trimming electrode 514*b* and a ground (not shown) of a mobile communication unit on which the chip antenna 510*b* is mounted, and between the trimming electrode 514*b* and the conductor 512*b*. In this modification, since a meandering conductor is formed only on one main surface of the substrate, the height of the substrate becomes smaller, thereby decreasing the height of the chip antenna. It should be noted that a meandering conductor may be provided within the substrate.

Figure 12:
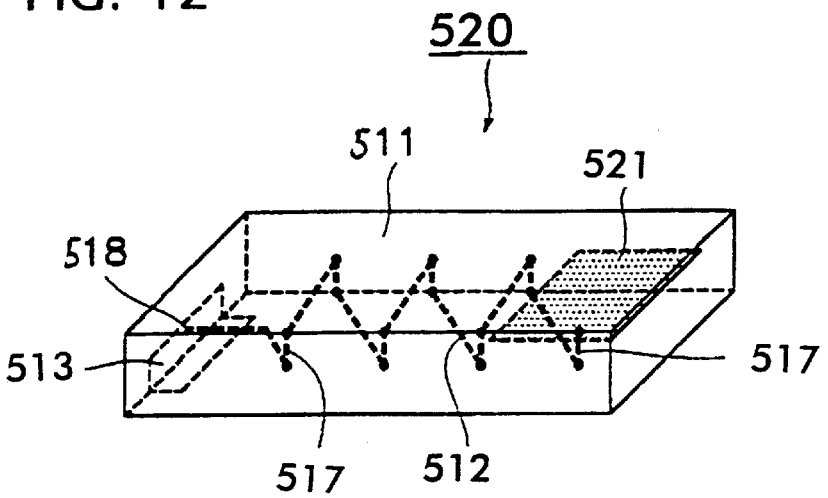
FIG. 12 is a perspective view illustrating a fourth embodiment of a chip antenna of the present invention.

FIG. 12 is a perspective view illustrating a fourth embodiment of a chip antenna of the present invention. A chip antenna 520 differs from the chip antenna 510 in that a trimming electrode is provided within a substrate. More specifically, the chip antenna 520 is formed of a rectangular prism substrate 511, a conductor 512 spirally wound within the substrate 511 in the longitudinal direction of the substrate 511, a power feeding terminal 513, and a trimming electrode 521 generally formed in a rectangle. The power feeding terminal 513 is provided over surfaces of the substrate 511 in order to apply a voltage to the conductor 512 and is connected to one end of the conductor 512. The trimming electrode 521 is provided within the substrate 511 and is connected to the other end of the conductor 512. With the above construction, a capacitive coupling is formed between the trimming electrode 521 and a ground (not shown) of a mobile communication unit on which the chip antenna 520 is mounted and between the trimming electrode 521 and the conductor 512.

According to the manufacturing method for the trimming electrode 521, in a chip antenna, such as the one shown in FIG. 9, the trimming electrode 521 is formed together with the conductor patterns 516*e* through 516*g* on the surface of the sheet layer 515*b*.

Figure 13:
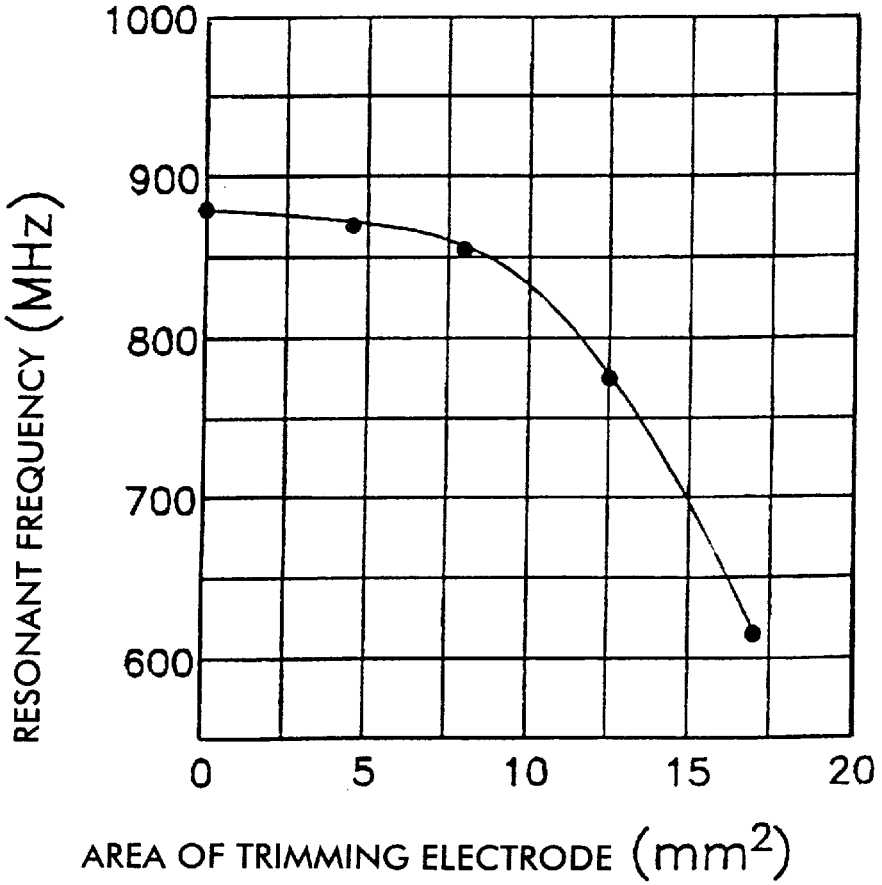
FIG. 13 is a diagram illustrating the relationship between the area of the trimming electrode and the resonant frequency of the chip antenna.

FIG. 13 illustrates the relationship between the measured area S ($mm^2$) of the trimming electrode and the resonant frequency f (GHz) of the chip antenna. The relative dielectric constant of a dielectric material for the substrate is approximately 6.1.

FIG. 13 reveals that an increase in the area of the trimming electrode decreases the resonant frequency. More specifically, a trimming electrode having an area of about 16.8 ($mm^2$) is formed on a chip antenna having a resonant frequency of about 880 (MHz), thereby reducing the resonant frequency to be approximately 615 (MHz).

Figure 14:
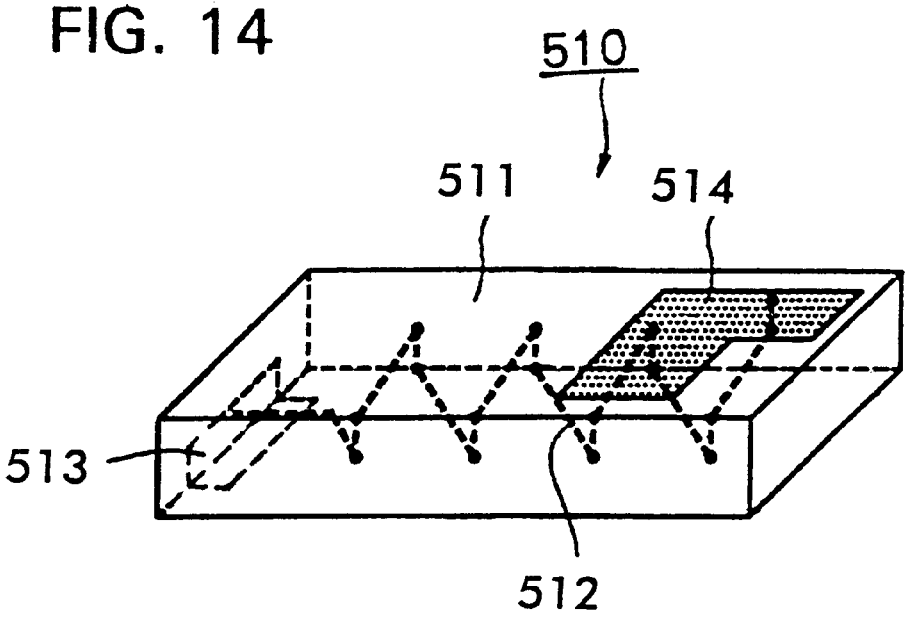
FIG. 14 is a perspective view illustrating the chip antenna shown in FIG. 8 provided with the partially cut trimming electrode.

A method for adjusting the resonant frequency in the manufacturing process for actual products is explained as an example by referring to the chip antenna 510 of the first embodiment. A trimming electrode 514 having a predetermined area is cut by laser, as illustrated in FIG. 14, thereby decreasing the area of the trimming electrode 514 and increasing the resonant frequency of the chip antenna 510.

In a chip antenna, such as the one 520 shown in FIG. 12, the trimming electrode 521 formed within the substrate 511 is cut together with the substrate 511.

The foregoing adjustment for the resonant frequency is explained below by using an equation. When the inductance component of the conductor is indicated by L, and a capacitive coupling generated between the end of the conductor connected to the trimming electrode and a ground of a mobile communication unit on which the chip antenna is mounted is represented by C1, a capacitive coupling generated between the trimming electrode and a ground of the mobile communication unit on which the chip antenna is mounted is designated by C2, and a capacitive coupling generated between the trimming electrode and the conductor is indicated by C3, the resonant frequency f is expressed by the following equation.

$$f = \frac{1}{2\pi\sqrt{L(C1 + C2 + C3)}}$$

Consequently, the area of the trimming electrode is decreased to reduce the capacitive couplings C2 and C3, thereby increasing the resonant frequency f.

According to the configuration of each of the chip antennas of the foregoing third and fourth embodiments, a trimming electrode connected to the other end of the conductor is provided. This makes it possible to form a capacitive coupling between the trimming electrode and a conductor and between the trimming electrode and a ground of a mobile communication unit on which the chip antenna is mounted. Accordingly, by adjusting the area of the trimming electrode, the capacitive coupling of the chip antenna is adjustable, thereby enabling the adjustment of the resonant frequency of the chip antenna. As a consequence, the resonant frequency is easily adjustable in the manufacturing process of the chip antenna, thereby improving the yield of the chip antenna.

Figure 15:
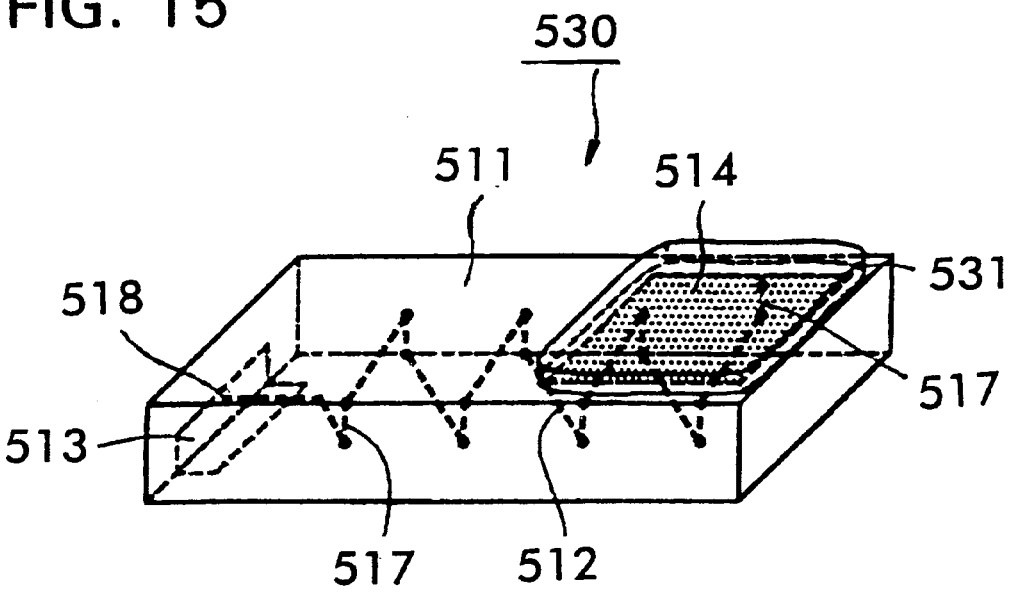
FIG. 15 is a perspective view illustrating a fifth embodiment of a chip antenna of the present invention.

FIG. 15 is a perspective view illustrating a fifth embodiment of a chip antenna of the present invention. A chip antenna 530 is different from the chip antenna 510 in that a trimming electrode is coated with a resin layer. More specifically, the chip antenna 530 is formed of a rectangular prism substrate 511, a conductor 512 spirally wound within the substrate 511 in the longitudinal direction of the substrate 511, a power feeding terminal 513, a trimming electrode 514 formed generally in a rectangle, and a resin layer 531 covering the trimming electrode 514. The power feeding terminal 513 is formed over surfaces of the substrate 511 in order to apply a voltage to the conductor 512 and is connected to one end of the conductor 512. The trimming electrode 514 is provided within the substrate 511 and is connected to the other end of the conductor 512.

According to the configuration of the chip antenna of the above-described third embodiment, the trimming electrode is covered with a resin layer, thereby improving environment-resistance characteristics and further enhancing the reliability of the chip antenna.

In the foregoing chip antennas, the substrate of the chip antenna or the substrate of the antenna unit is made of a dielectric material essentially consisting of barium oxide, aluminum oxide, and silica. However, the substrate is not restricted to the above type of dielectric material, and may be made of a dielectric material essentially consisting of titanium oxide and neodymium oxide, a magnetic material essentially consisting of nickel, cobalt and iron, or a combination of a dielectric material and a magnetic material.

Although only one conductor is provided for the foregoing embodiments, a plurality of conductors located in parallel to each other may be provided. In this case, the resulting chip antenna has a plurality of resonant frequencies in accordance with the number of conductors, thereby making it possible to cope with multi bands in one chip antenna or in one antenna unit.

Moreover, although in the foregoing embodiments, the trimming electrode is formed generally in the shape of a rectangle, it may be linear, or formed generally in the shape of a circle, an ellipse, or a polygon. Alternatively, the trimming electrode may be formed in an internally hollowed-out shape, a comb-like shape, or a group-like shape, as shown in FIGS. 9(*a*) through 9(*c*), respectively.

Further, in the foregoing embodiments, the conductor is formed within or on the surface of the substrate. However, a spiral or meandering conductor may be formed both on a surface and within the substrate.

A laser is used to cut the trimming electrode. Additionally, a sandblaster or a toother may be used.

FIG. 17 shows a partial top plan view of a sixth embodiment of an antenna apparatus of the present invention, which can be utilized for the mobile image apparatus of the present invention. An antenna apparatus 710 comprises chip antennas 811 and 812 provided with a power feeding terminal 701 and a free terminal 702, a chip coil 712, which is an inductance element, and a mounting substrate 714 having lands 831 to 833 formed on its surface.

Then, the power feeding terminal 701 of the chip antenna 811 is connected to one end of the land 831, and the free terminal 702 of the chip antenna 811 is connected to one end of the land 832. Further, one end of the chip coil 712 is connected to the other end of the land 832, and the other end of the chip coil 712 is connected to one end of the land 833.

Furthermore, the power feeding terminal 701 of the chip antenna 812 is connected to the other end of the land 833. The other end of the land 831 is connected to the high-frequency circuit section RF of a portable video apparatus (not shown) in which the antenna apparatus 710 is mounted.

That is, the construction is formed such that the chip antenna 811, the chip coil 712, and the chip antenna 812 are connected in series between the high-frequency circuit section RF, and a ground, for example, the case body of the portable video apparatus (not shown) in which the antenna apparatus 710 is mounted.

In the antenna apparatus shown in FIG. 17, the chip antenna shown in FIGS. 2, 3, 5 and 6 can be applied as the chip antennas 811 and 812.

Figure 18:
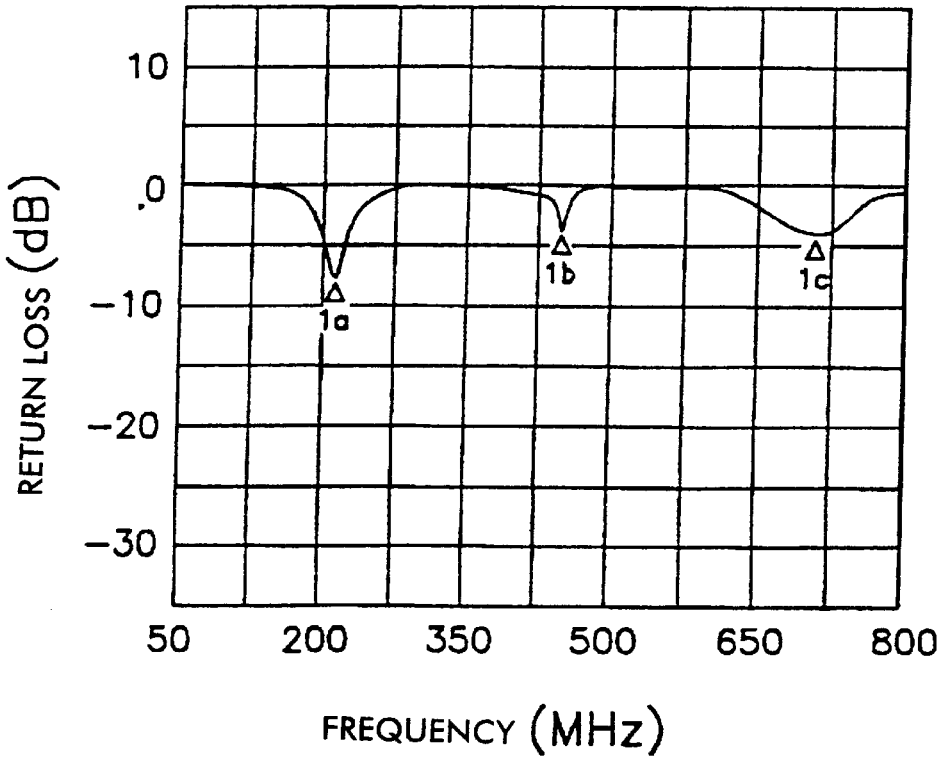
FIG. 18 is a view showing the frequency characteristics of the antenna apparatus of FIG. 17.

FIG. 18 shows the frequency characteristics of the antenna apparatus 710 of FIG. 17. At this point, the resonance frequencies of the chip antenna 811 is 387.2 MHz, the resonance frequency of the chip antenna 812 is 814.5 MHz, and the inductance value of the chip coil 812 is 220 nH.

It can be seen from FIG. 18 that the antenna apparatus 710 has three resonance frequencies of 233.1 MHz (1*a* in FIG. 18), 463.8 MHz (1*b* in FIG. 18), and 722.9 MHz (1*c* in FIG. 18), and a wider band of the antenna apparatus 710 has been realized. That is, the band of the antenna apparatus 710 is in a range of 233.1 to 722.9 MHz, making it possible to receive a VHF band and a UHF band.

The dimensions of the chip antenna 811, which forms the antenna apparatus 710, capable of obtaining the frequency characteristics of FIG. 18, are 10×6.3×3.4 mm, and the dimensions of the chip antenna 812 are 8×5×2.5 mm; the length of the whole of the antenna apparatus 710 is therefore about 20 to 30 mm. Hence, in the range of the VHF band and the UHF band, the size of the antenna apparatus is reduced to 1/30 to 1/40 that of the conventional monopole antenna.

According to the above-described antenna apparatus of the sixth embodiment, since two chip antennas are used having conductors formed on the surface of the substrate and/or within the substrate formed of either one of a dielectric material and a magnetic material, the propagation speed becomes slow, and a shortening of the wavelength occurs. Therefore, if the specific dielectric constant of the substrate is denoted as $\epsilon$, the effective line length becomes $\epsilon^{1/2}$ times, which is longer than the effective line length of a conventional monopole antenna. As a result, if it is at the same effective line length, it becomes far smaller than the conventional monopole antenna, making it possible to easily mount the chip antennas within the case body. Therefore, the antenna apparatus does not protrude from the case body even during reception.

Further, since two chip antennas having a different resonance frequency are connected in series to each other via a chip coil, the antenna apparatus possesses three different resonance frequencies, and a wider band of the antenna apparatus can be realized. Therefore, a small antenna apparatus having a size 1/30 to 1/40 that of the conventional monopole antenna is capable of receiving the VHF band and the UHF band. As a result, even during reception the antenna apparatus can be mounted in a portable video apparatus, and a stable portable video apparatus can be obtained.

Figure 19:
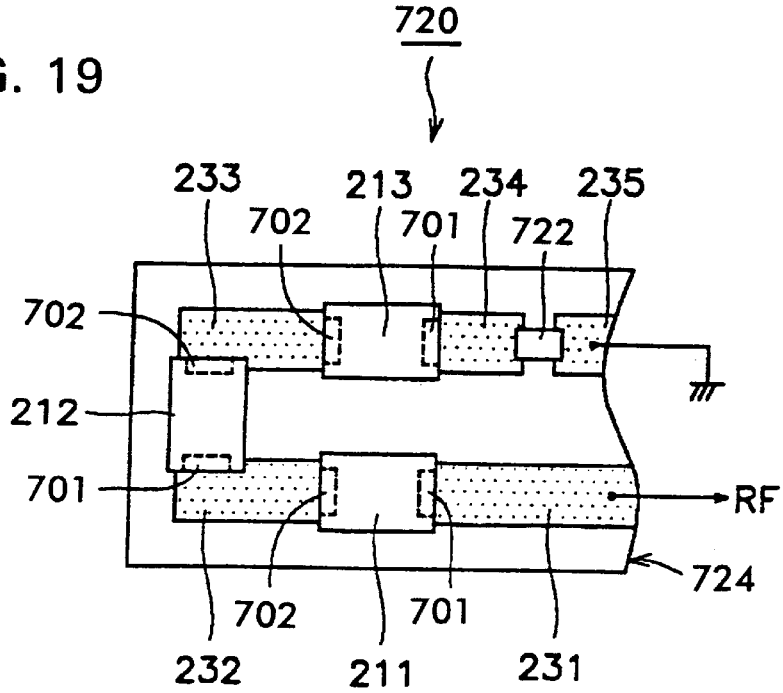
FIG. 19 is a partial top plan view of a seventh embodiment of the antenna apparatus of the present invention.

FIG. 19 shows a partial top plan view of a seventh embodiment of the antenna apparatus of the present invention. An antenna apparatus 720 comprises chip antennas 211 to 213 provided with a power feeding terminal 701 and a free terminal 702, a trimmer capacitor 722, which is a variable capacitance element, and a mounting substrate 724 having lands 231 to 235 formed on its surface.

The power feeding terminal 701 of the chip antenna 211 is connected to one end of the land 231, and the free terminal 702 of the chip antenna 211 is connected to one end of the land 232. Further, the power feeding terminal 701 of the chip antenna 212 is connected to the other end of the land 232, and the free terminal 702 of the chip antenna 212 is connected to one end of the land 233.

Further, the power feeding terminal 701 of the chip antenna 213 is connected to the other end of the land 233, and the free terminal 702 of the chip antenna 213 is connected to one end of the land 234. Further, one end of the trimmer capacitor 722 is connected to the other end of the land 234, and the other end of the trimmer capacitor 722 is connected to one end of the land 235. Further, the other end of the land 231 is connected to the high-frequency circuit section RF of a portable video apparatus (not shown) in which the antenna apparatus 720 is mounted, and the other end of the land 235 is connected to a ground, for example, the case body of the portable video apparatus (not shown) in which the antenna apparatus 720 is mounted.

That is, the construction is formed such that the chip antenna 211, the chip antenna 212, the chip antenna 213, and the trimmer capacitor 722 are connected in series between the high-frequency circuit section RF, and a ground, for example, the case body of the portable video apparatus (not shown) in which the antenna apparatus 720 is mounted.

Figure 20:
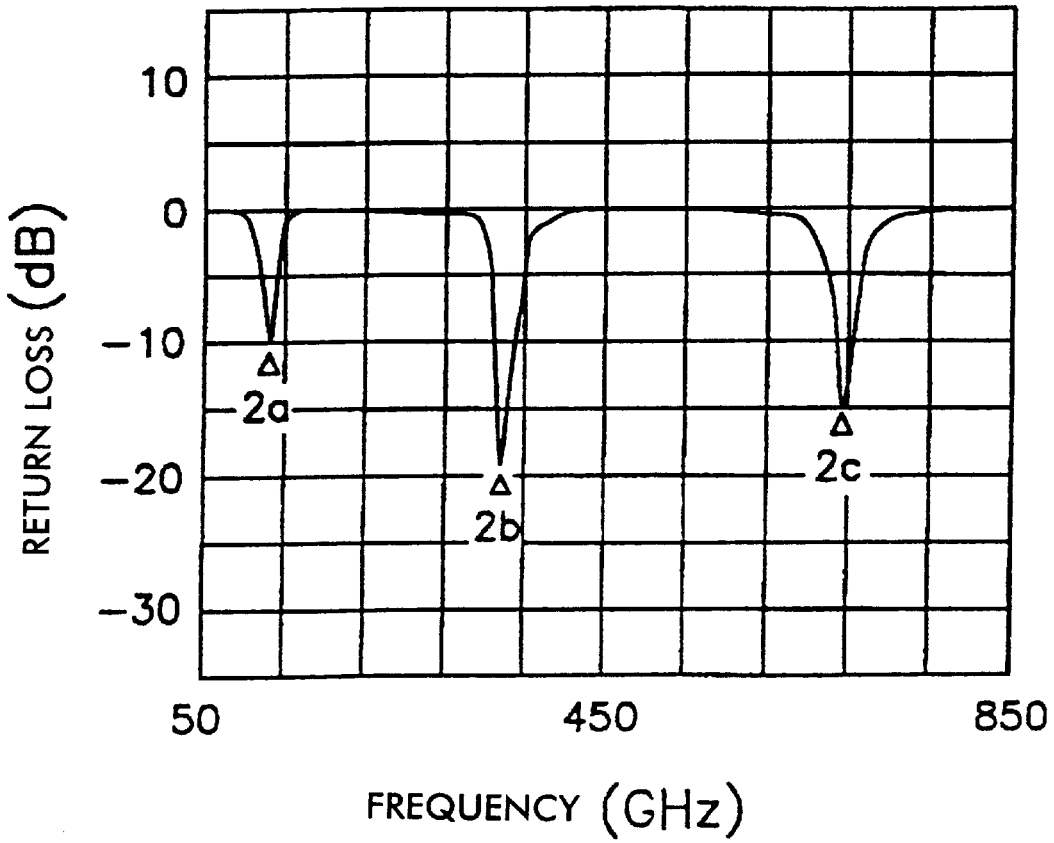
FIG. 20 is a view showing the frequency characteristics in the case where the capacitance value of a variable capacitance element is 0.5 pF in the antenna apparatus of FIG. 19.

FIG. 20 shows the frequency characteristics of the antenna apparatus 720 of FIG. 19. At this point, the resonance frequency of the chip antenna 211 is 875.0 MHz, the resonance frequency of the chip antenna 212 is 540.0 MHz, the resonance frequency of the chip antenna 213 is 231.1 MHz, and the capacitance value of the trimmer capacitor 722 is 0.5 pF.

It can be seen from FIG. 20 that the antenna apparatus 720 has three resonance frequencies of 120.3 MHz (2*a* 1n FIG. 24), 360.9 MHz (2*b* in FIG. 24), and 688.4 MHz (2*c* in FIG. 24), and a wider band of the antenna apparatus 720 has been realized. That is, the band of the antenna apparatus 720 is in a range of 120.3 to 688.4 MHz.

Figure 21:
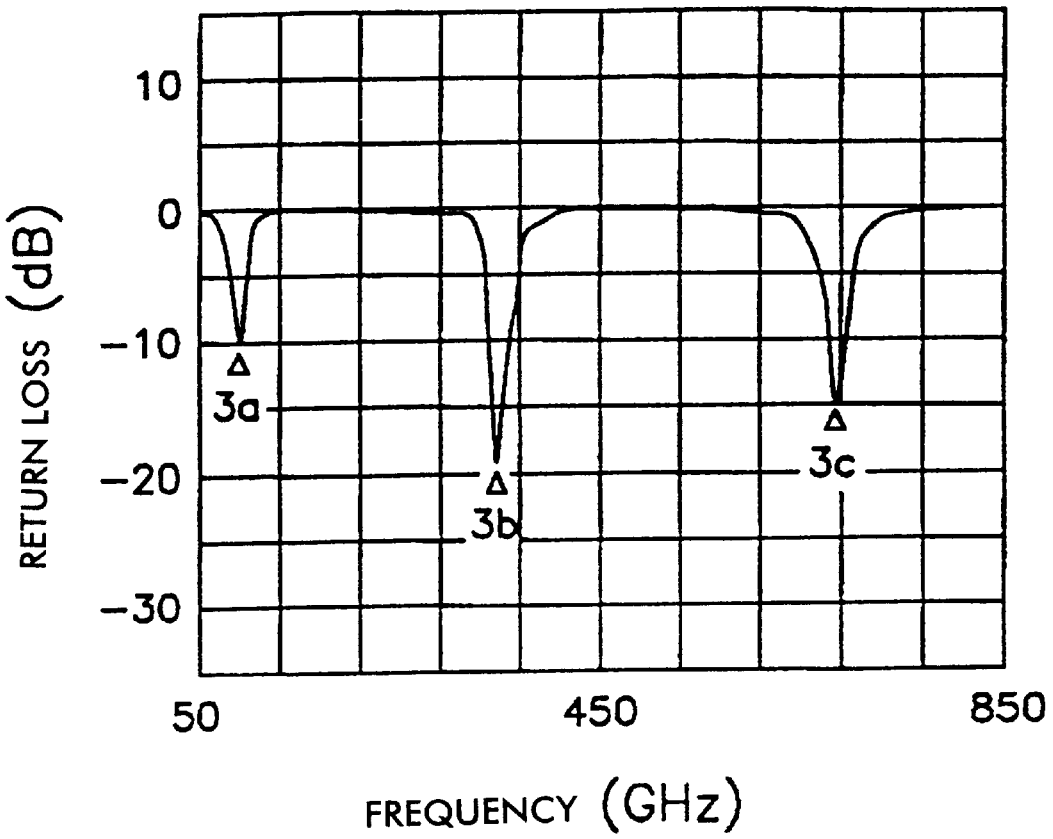
FIG. 21 is a view showing the frequency characteristics in the case where the capacitance value of the variable capacitance element is 1.5 pF in the antenna apparatus of FIG. 19.

FIG. 21 shows the frequency characteristics in the case where the capacitance value of the trimmer capacitor 722 is 1.5 pF in the antenna apparatus 720 of FIG. 19. It can be seen from FIG. 21 that the antenna apparatus 720 has three resonance frequencies of 91.0 MHz (3*a* in FIG. 21), 360.9 MHz (3*b* in FIG. 21), and 688.4 MHz (3*c* in FIG. 21). That is, the band is in a range of 91.0 to 688.4 MHz, and by increasing the capacitance value of the trimmer capacitor 722, it is possible to move only the lowest resonance frequency to 91.0 MHz without moving the other resonance frequencies. As a result, the antenna apparatus 710 is capable of receiving a lower frequency range.

According to the above-described antenna apparatus of the seventh embodiment, since three chip antennas are connected in series and a trimmer capacitor is connected in series to the free terminal of the third chip antenna, by varying the capacitance value of the trimmer capacitor, it is possible to move only the lowest resonance frequency without moving the other resonance frequencies. As a result, since the antenna apparatus is capable of receiving a lower frequency range, the portable video apparatus in which the antenna apparatus is mounted is capable of receiving a lower frequency range.

Figure 22:
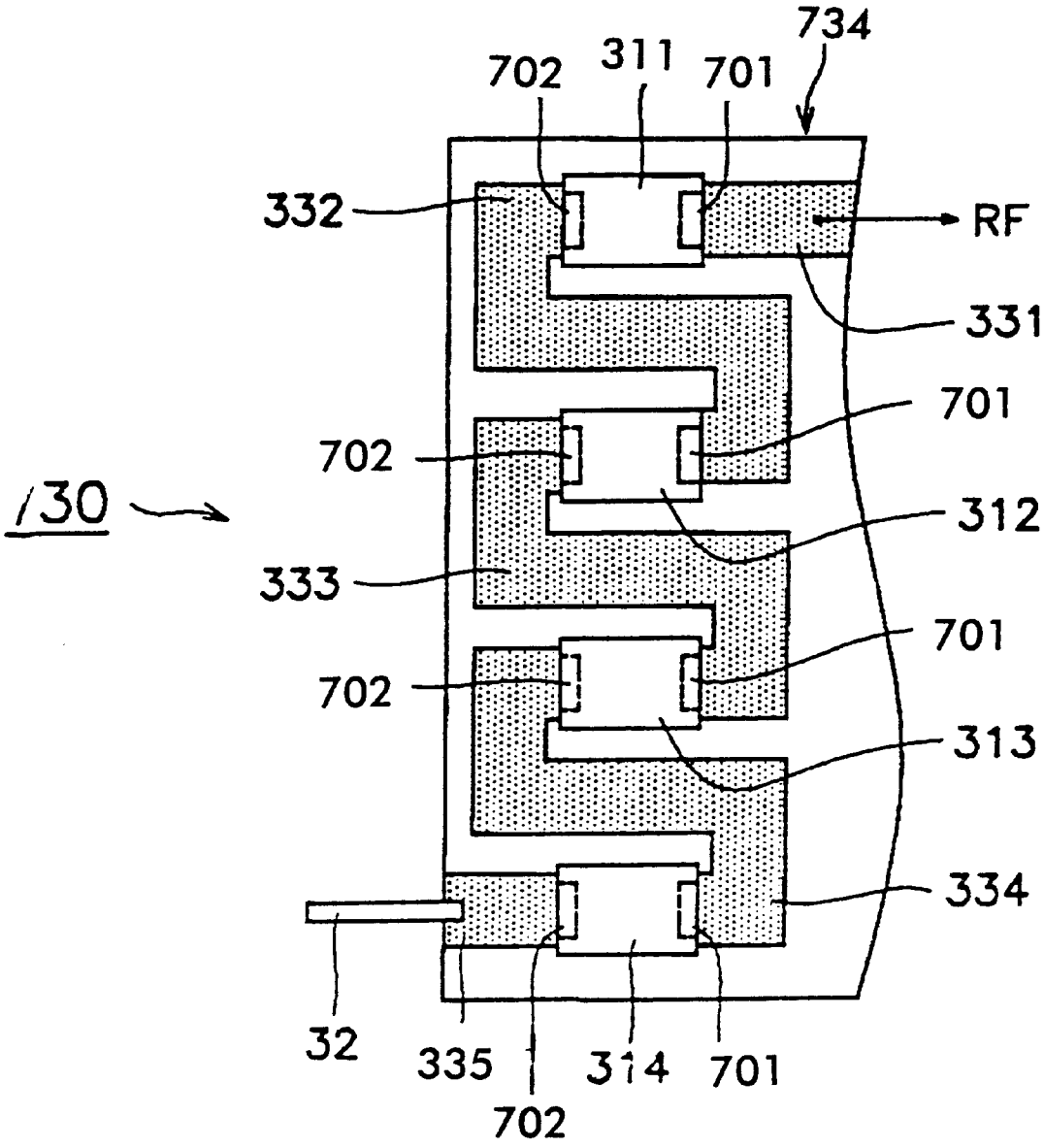
FIG. 22 is a partial top plan view of an eighth embodiment of the antenna apparatus of the present invention.

FIG. 22 shows a partial top plan view of a eighth embodiment of the antenna apparatus of the present invention. An antenna apparatus 730 comprises chip antennas 311 to 314 provided with a power feeding terminal 701 and a free terminal 702, and a plating wire 732, which is a radiation conductor, and a mounting substrate 734 having lands 331 to 335 formed on its surface.

The power feeding terminal 701 of the chip antenna 311 is connected to one end of the land 331, and the free terminal 702 of the chip antenna 311 is connected to one end of the land 332. Further, the power feeding terminal 701 of the chip antenna 312 is connected to the other end of the land 332, and the free terminal 702 of the chip antenna 312 is connected to one end of the land 333.

Further, the power feeding terminal 701 of the chip antenna 313 is connected to the other end of the land 333, and the free terminal 702 of the chip antenna 314 is connected to one end of the land 334. Further, the power feeding terminal 701 of the chip antenna 314 is connected to the other end of the land 334, and the free terminal 702 of the chip antenna 314 is connected to one end of the land 335.

Further, the other end of the land 331 is connected to the high-frequency circuit section RF of a portable video apparatus (not shown) in which the antenna apparatus 730 is mounted, and the plating wire 732 is connected to the other end of the land 335.

That is, the construction is formed such that the chip antenna 311, the chip antenna 312, the chip antenna 313, the chip antenna 314, and the plating wire 732 are connected in series between the high-frequency circuit section RF, and a ground, for example, the case body of the portable video apparatus (not shown) in which the antenna apparatus 730 is mounted.

Figure 23:
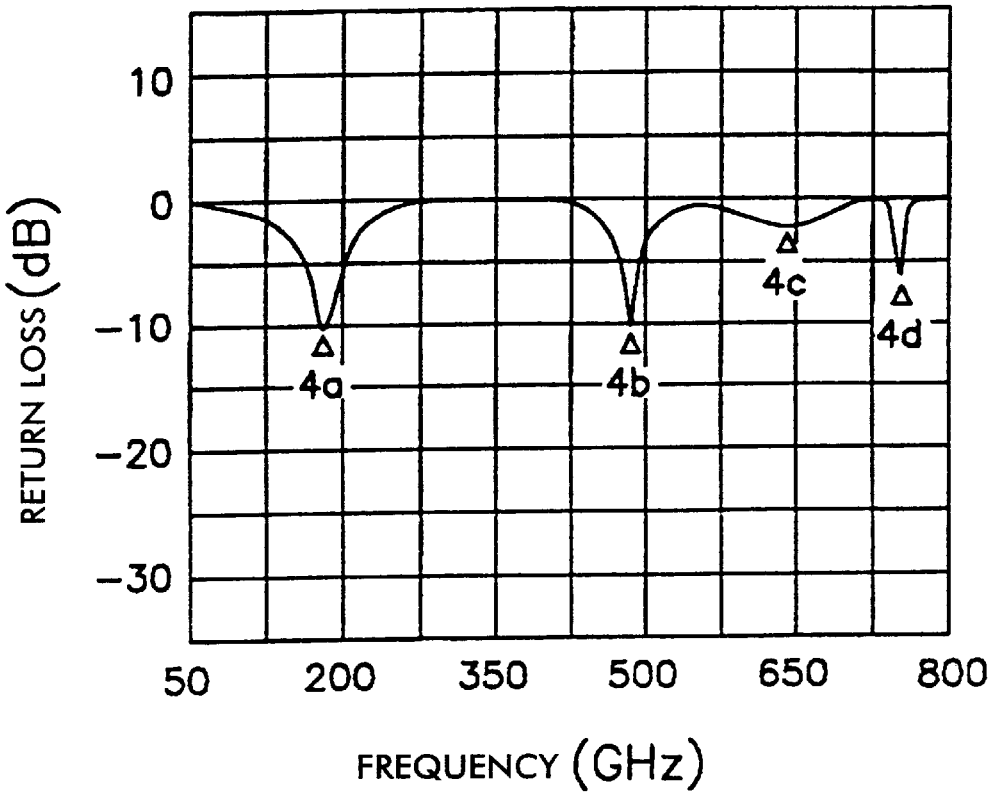
FIG. 23 is a view showing the frequency characteristics of the antenna apparatus of FIG. 22.
Figure 26:
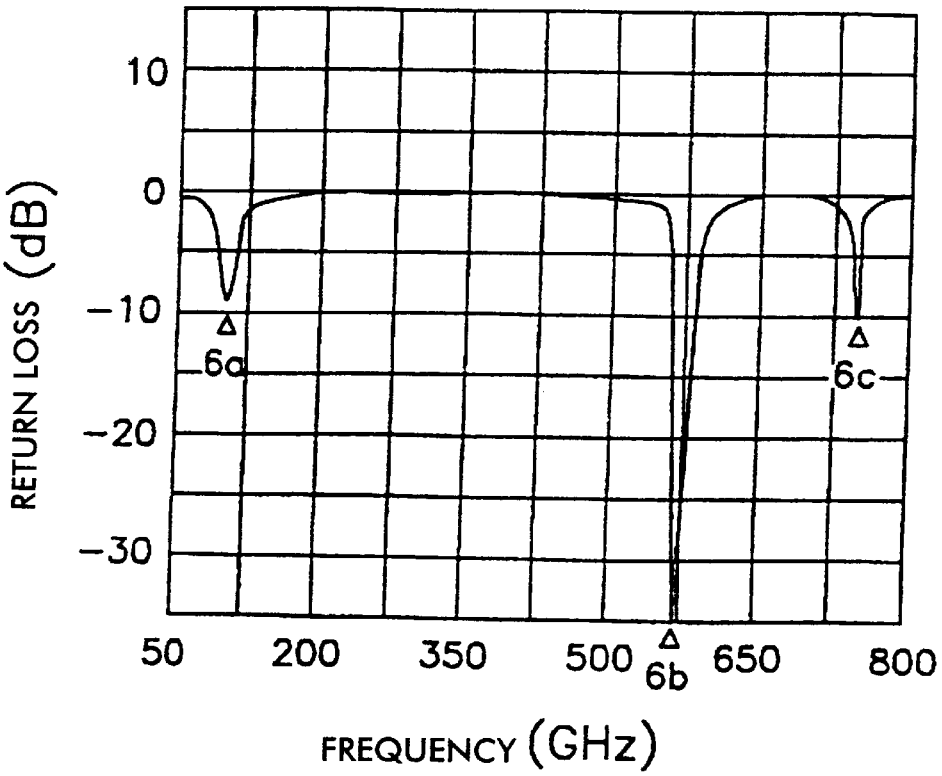
FIG. 26 is a view showing the frequency characteristics in the case where the switching element is on in the antenna apparatus of FIG. 24.

FIG. 23 shows the frequency characteristics of the antenna apparatus 730 of FIG. 26. At this point, the resonance frequency of the chip antennas 311 to 313 is 875.0 MHz, the resonance frequency of the chip antenna 314 is 1.240 GHz, and the length of the plating wire 372 is 20 cm.

It can be seen from FIG. 23 that the antenna apparatus 730 has four resonance frequencies of 187.6 MHz (4*a* in FIG. 23), 481.6 MHz (4*b* in FIG. 23), 648.2 MHz (4*c* in FIG. 23), and 748.8 MHz (4*d* in FIG. 23), and a wider band of the antenna apparatus 730 has been realized. That is, the band of the antenna apparatus 730 is in a range of 187.6 to 748.8 MHz.

According to the above-described antenna apparatus of the eighth embodiment, since the plating wire, which is a radiation conductor, is connected to the free terminal of the fourth chip antenna and the plating wire functions as a part of the antenna apparatus, the radiation area of the antenna apparatus is not decreased. Therefore, even if the chip antenna is formed into a smaller size, the gain of the antenna apparatus can be maintained without being decreased.

Figure 24:
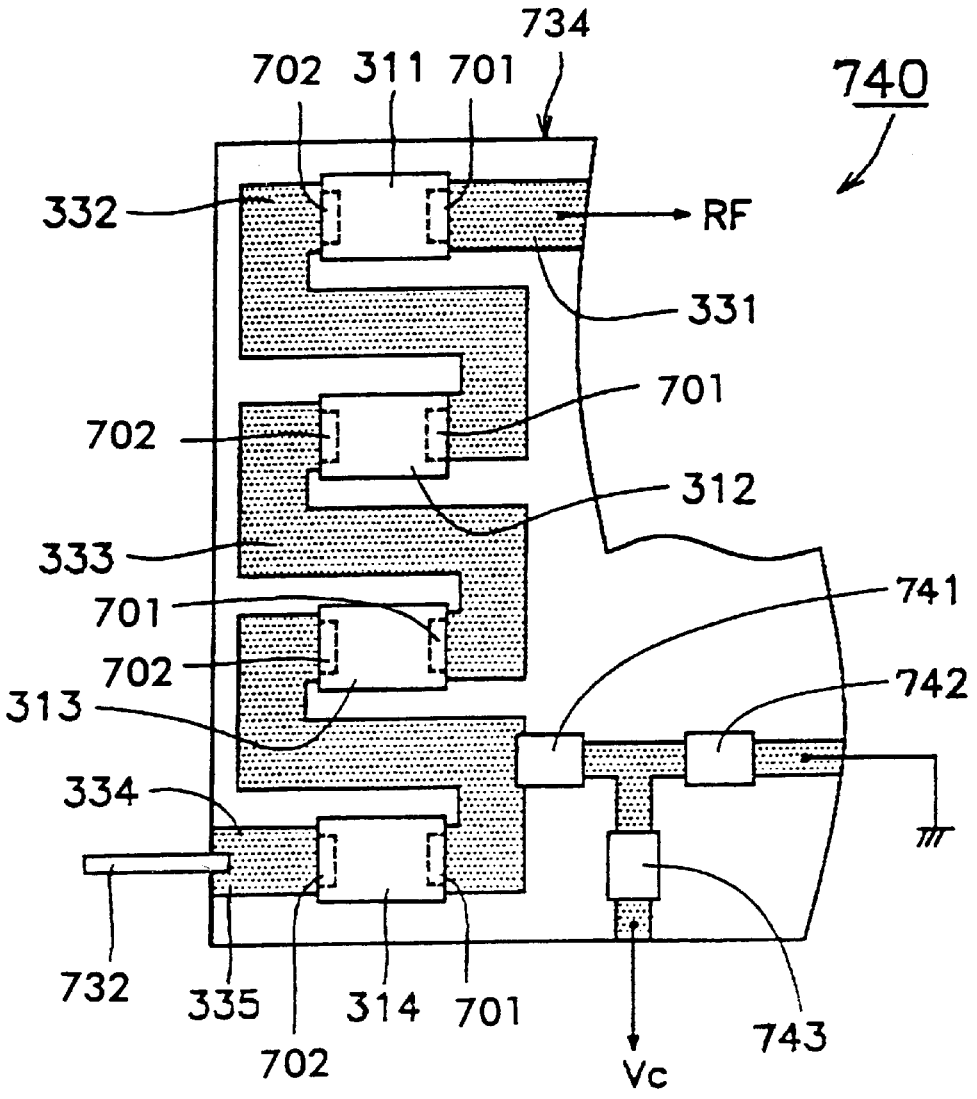
FIG. 24 is a partial top plan view of a ninth embodiment of the antenna apparatus of the present invention.

FIG. 24 shows a partial top plan view of a ninth embodiment of the antenna apparatus of the present invention. An antenna apparatus 740 differs from the antenna apparatus 730 of the third embodiment in that a series circuit of a capacitor 741, which is a capacitance element, and a diode 742, which is a switching element, is connected between the land 334 between the free terminal 702 of the third chip antenna 313 and the power feeding terminal 701 of the ninth chip antenna 314, and the ground, and a control voltage Vc of the diode 742 is connected to the connection point of the capacitor 741 and the diode 74 via a resistor 743.

Figure 25:
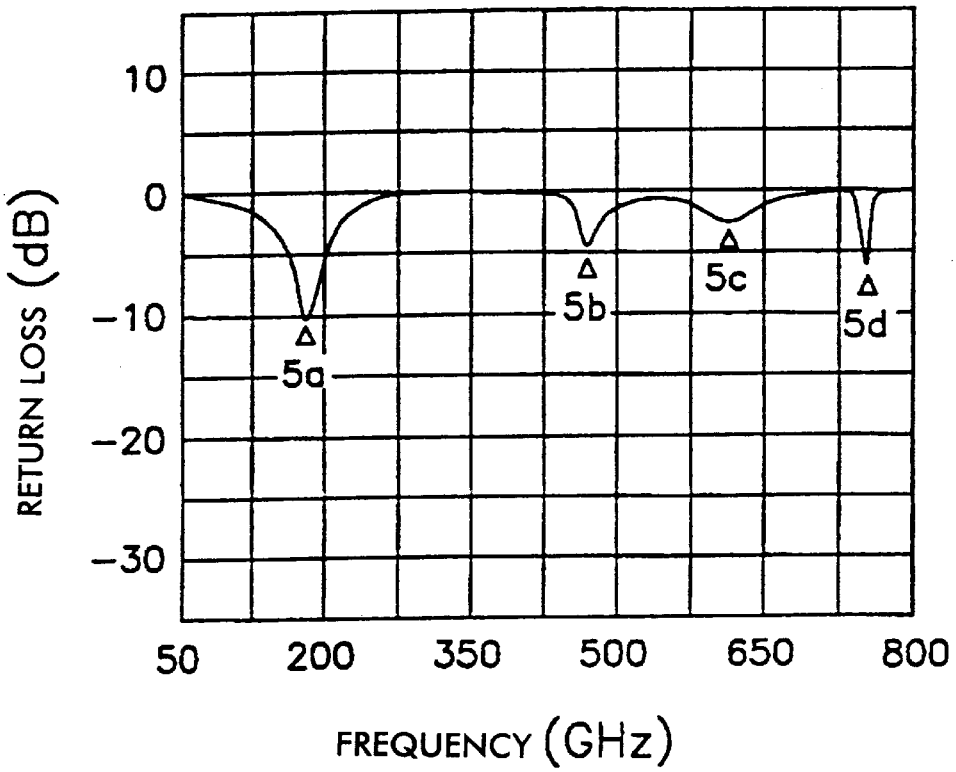
FIG. 25 is a view showing the frequency characteristics in the case where the switching element is off in the antenna apparatus of FIG. 24.

FIG. 25 shows the frequency characteristics in the case where the diode 742 is turned off, that is, the diode 742 is short-circuited in the antenna apparatus 740 of FIG. 24. It can be seen from FIG. 25 that the antenna apparatus 740 has four resonance frequencies of 169.1 MHz (5*a* in FIG. 25), 471.4 MHz (5*b* in FIG. 25), 615.1 MHz (5*c* in FIG. 25), and 748.1 MHz (5*d* in FIG. 25), and the respective resonance frequencies are moved to low frequencies. That is, the band of the antenna apparatus 740 is in a range of 169.1 to 748.1 MHz. The reason for this is that since the capacitance components of the entire antenna apparatus 740 are increased by the capacitance value of the capacitor 741, the band is moved to low frequencies.

FIG. 26 shows the frequency characteristics in the case where the diode 742 is turned on in the antenna apparatus 740 of FIG. 24. It can be seen from FIG. 26 that the antenna apparatus 740 has three resonance frequencies of 108.3 MHz (6*a* in FIG. 26), 572.1 MHz (6*b* in FIG. 26), and 744.6 MHz (6*c* in FIG. 26), and the respect resonance frequencies are moved to low frequencies. That is, the band of the antenna apparatus 740 is in a range of 108.3 to 744.6 MHz. The reason for this is that since the capacitance components of the entire antenna apparatus 740 are increased more by the capacitance value of the capacitor 741 and the diode 742, the band is moved to lower frequencies.

Figure 29:
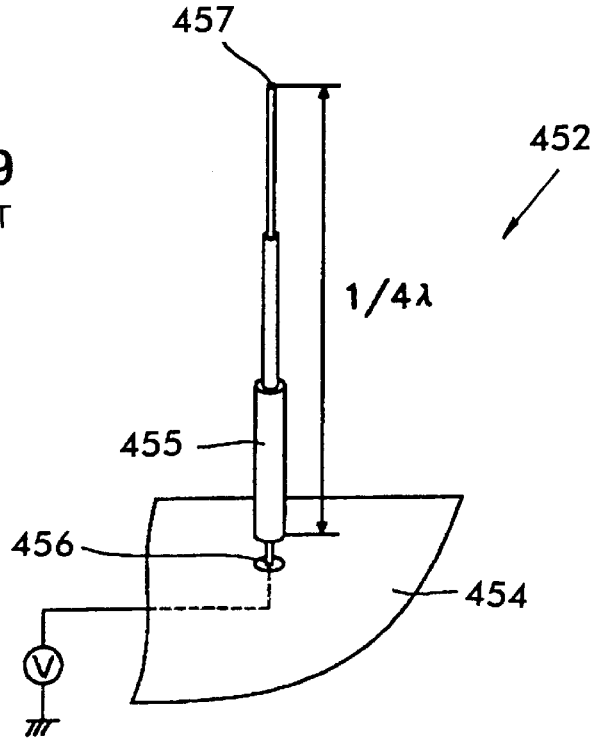
FIG. 29 PRIOR ART
FIG. 29 is a perspective view illustrating a rod antenna forming the mobile image apparatus shown in FIG. 28.

Here, Table 1 shows the sensitivity difference between the antenna apparatus 740 of FIG. 24 and the conventional monopole antenna 452 (FIG. 29) in 1 ch to 12 ch (VHF band), which are the channels of a conventional television, and in 13 ch to 62 ch (UHF band).

TABLE 1

| Sensitivity Difference [dB] between Antenna Apparatus 740 and Monopole Antenna 780 (Antenna Apparatus 740 − Monopole Antenna 780) | | | |
|---|---|---|---|
| 1ch | 0 | 14ch | 0 |
| 3ch | 0 | 20ch | 0 |
| 4ch | 0 | 26ch | 0 |
| 5ch | 1 | 31ch | 1 |
| 6ch | 2 | 35ch | 1 |
| 8ch | 1.5 | 41ch | 1 |
| 10ch | 1.5 | 46ch | 1 |
| 11ch | 1 | 54ch | 0 |
| 12ch | 0 | 61ch | 0 |

It can be seen from Table 1 that as a result of receiving higher frequencies of the VHF band, and a UHF band when the diode 742 is off and receiving lower frequencies of the VHF band when the diode 742 is on, the sensitivity difference between the antenna apparatus 740 and the conventional monopole antenna 780 is in a range of 0 to 2 [dB], and the sensitivity of the antenna apparatus 740 and that of the conventional monopole antenna 780 are nearly equal.

According to the above-described antenna apparatus of the ninth embodiment, since a series circuit of the capacitor and the diode is connected between the free terminal of the third chip antenna and the power feeding terminal of the fourth chip antenna, the band of the antenna apparatus can be moved to low frequencies.

Further, by varying the capacitance value of the capacitor to a desired value, the band of the antenna apparatus can be a desired value.

Further, by turning on/off the diode, the band of the antenna apparatus can be moved. Therefore, it becomes possible for one antenna apparatus to be provided with a plurality of bands, and as a result, a portable video apparatus in which this one small antenna apparatus is mounted becomes capable of receiving a signal of a wide range of frequencies, for example, a VHF band and a UHF band at a sensitivity equal to that of the conventional monopole antenna.

Figure 27:
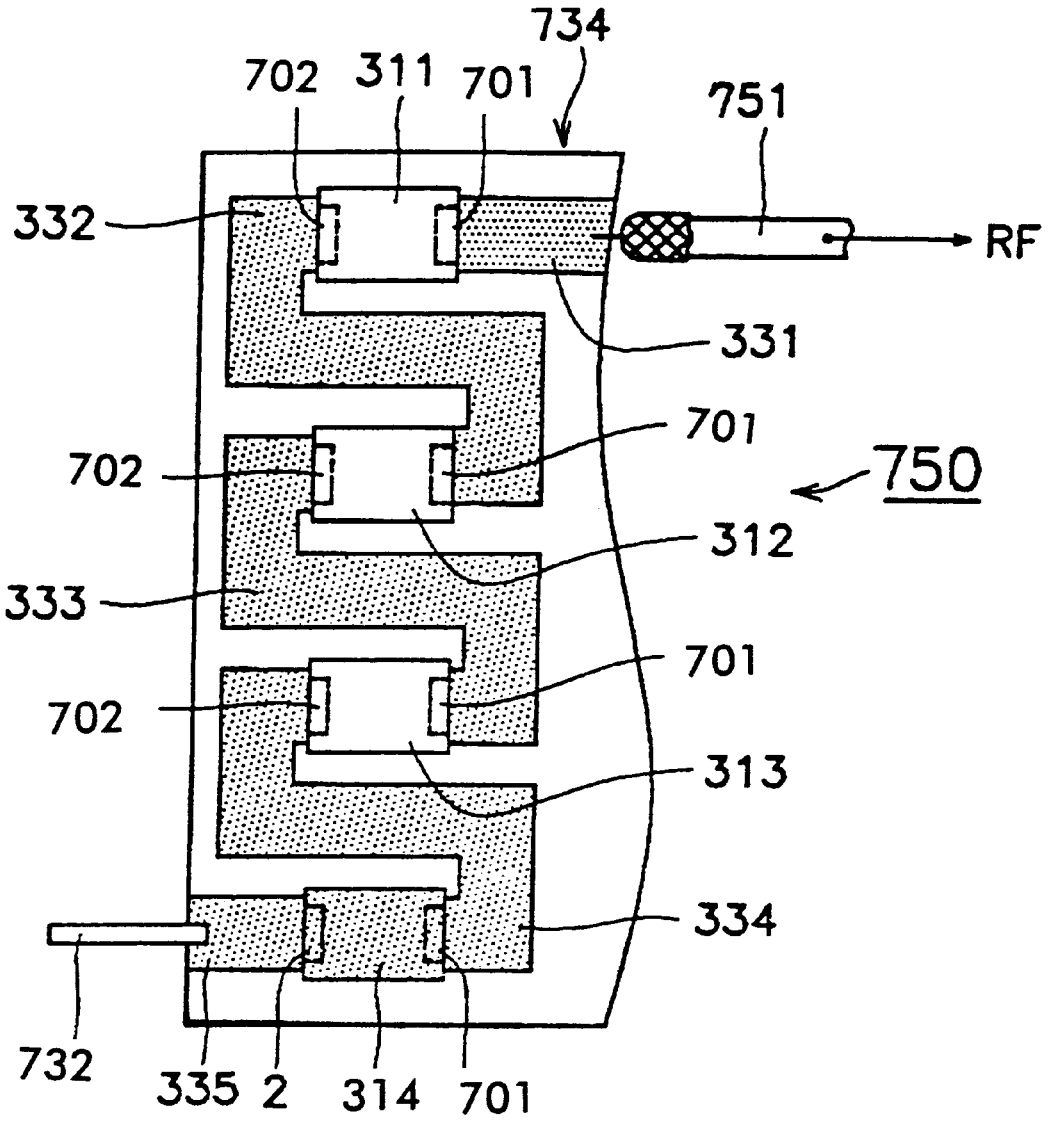
FIG. 27 is a partial top plan view of a tenth embodiment of the antenna apparatus of the present invention.
Figure 28:
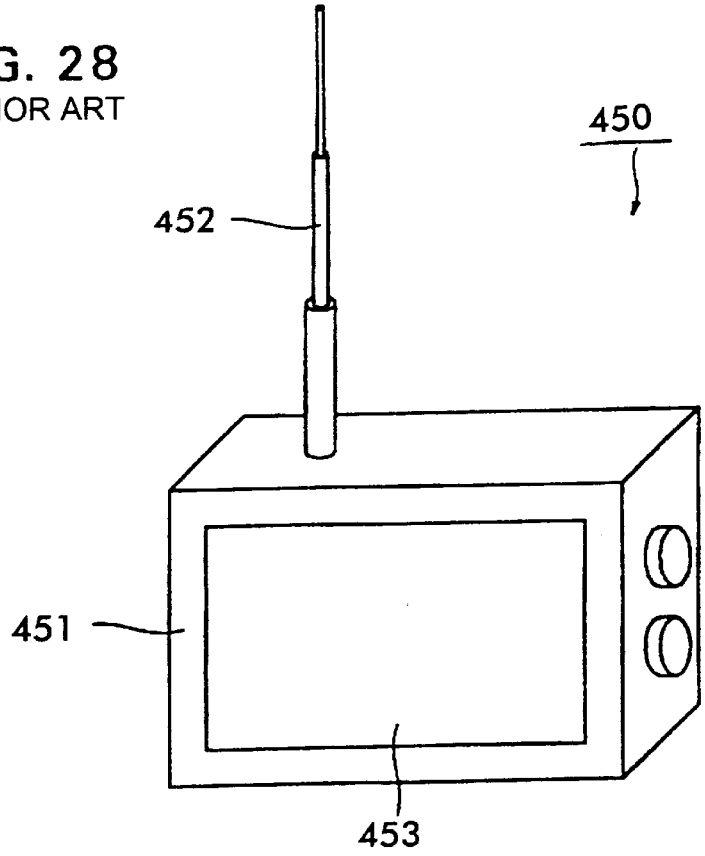
FIG. 28 PRIOR ART
FIG. 28 is a front view illustrating a conventional mobile image apparatus.

FIG. 27 shows a partial top plan view of a tenth embodiment of the antenna apparatus of the present invention. An antenna apparatus 750 differs from the antenna apparatus 730 of the eighth embodiment in that, one end of the land 331, which is connected to the power feeding terminal 701 of the first chip antenna 311 at the other end, is connected via a coaxial cable 751 to the high-frequency circuit section RF of a portable video apparatus (not shown) in which the antenna apparatus 750 is mounted.

According to the above-described antenna apparatus of the tenth embodiment, since a coaxial cable is connected to the power feeding terminal of the first chip antenna, when digital noise is generated from the portable video apparatus in which the antenna apparatus is mounted, a shielded coaxial cable cuts off the digital noise. Therefore, it is possible to prevent the antenna apparatus from receiving digital noise from the portable video apparatus in which the antenna apparatus is mounted.

Although in the above-described embodiments a case is described in which the substrate of the chip antenna is formed of a dielectric material having barium oxide, aluminum oxide, and silica as main constituents, the substrate is not limited to this dielectric material, and a dielectric material having titanium oxide, and neodymium oxide as main constituents, a magnetic material having nickel, cobalt, and iron as main constituents, or a combination of a dielectric material and a magnetic material may be used.

Although a case in which the number of conductors of the chip antenna is one is described, the chip antenna may have a plurality of conductors disposed in parallel to each other. In this case, it becomes possible to have a plurality of resonance frequencies according to the number of conductors, and an antenna apparatus having a wider band can be realized.

Further, although a case is described in which the conductors of the chip antenna are formed within the substrate or on the surface of the substrate, comparable advantages can be obtained even if they are formed within the substrate and on the surface of the substrate.

Further, the chip antennas shown in FIGS. 8 to 12 and 14 to 16 are also applicable to the antenna apparatus shown in FIG. 17, FIG. 19, FIG. 22, FIG. 24 and FIG. 27 instead of the chip antennas shown in FIGS. 2, 3, 5 and 6.

While the invention has been particularly shown and described with reference to preferred embodiments thereof, it will be understood by those skilled man in the art that the forgoing and other changes in form and details may be made therein without departing from the spirit of the invention.

What is claimed is:

1. A mobile image apparatus, comprising:

a case unit;

a plurality of chip antennas connected to each other and disposed at least one of within said case unit and outside said case unit; each of said chip antennas comprising;

a substrate comprising at least one of a dielectric material and a magnetic material;

at least one conductor disposed at least one of within said substrate and on a surface of said substrate;

at least one power feeding terminal disposed on a surface of said substrate and connected to a first end of said conductor for applying a voltage to said conductor, each of said chip antennas further comprising at least one free terminal disposed on a surface of said substrate connected to a second end of said conductor, and further wherein said plurality of chip antennas are connected in series by connecting their respective free terminals to power feeding terminals, the plurality of chip antennas having a respective different resonance frequency.

2. The mobile image apparatus according to claim 1, wherein an extra antenna is connected to one of said power feeding terminal and said free terminal.

3. The mobile image apparatus according to claim 1, wherein the plurality of said chip antennas are provided in accordance with receiving frequencies.

4. The mobile image apparatus according to claim 1, wherein at least one variable capacitance element is connected to said free terminal of the chip antenna.

5. The mobile image apparatus according to claim 4, wherein one of said variable capacitance elements is connected to said free terminal of the chip antenna at the final stage of said plurality of chip antennas which are connected to each other in series.

6. The mobile image apparatus according to claim 1, wherein a radiation conductor is connected to said free terminal of the chip antenna at the final stage.

7. The mobile image apparatus according to claim 1, wherein a capacitance element is connected between at least one of the connection points of said free terminal and said power feeding terminal, and a ground.

8. The mobile image apparatus according to claim 7, wherein a switching element is connected in series to said capacitance element.

9. The mobile image apparatus according to claim 1, wherein a coaxial cable is connected to the power feeding terminal of the chip antenna at the first stage of said plurality of chip antennas which are connected to each other in series.

10. The mobile image apparatus according to claim 1, wherein said chip antenna further comprise a trimming electrode disposed at least one of within said substrate and on a surface of said substrate and connected to the other end of said conductor.

11. The mobile image apparatus according to claim 10, further comprising a resin layer covering said trimming electrode.

12. The mobile image apparatus according to claim 11, wherein: said conductor is formed in a plane on one of a surface of the substrate in a meander shape.

13. The mobile image apparatus according to claim 10, wherein:

said substrate is formed by laminating a plurality of layers together, the layers each having a major surface; and said trimming electrode is disposed on one of the major surfaces of said layers.

14. The mobile image apparatus according to claim 10, wherein:

said substrate is formed by laminating a plurality of layers together, the layers each having a major surface and the substrate having a laminating direction normal to the major surface; and said conductor are spiral shaped and having a spiral axis disposed perpendicular to the laminating direction of said substrate.

15. An antenna apparatus, comprising:

a plurality of chip antennas connected to each other and having a different resonance frequency respectively, each of said chip antennas comprising:

a substrate comprising at least one of a dielectric material and a magnetic material;

at least one conductor disposed at least one of within said substrate and on a surface of said substrate;

at least one power feeding terminal disposed on a surface of said substrate and connected to a first end of said conductor for applying a voltage to said conductor; and at least one free terminal disposed on a surface of said substrate and connected to a second end of said conductor, and further wherein said plurality of chip antennas are connected in series by connecting their respective free terminals to power feeding terminals, the plurality of chip antennas having a respective different resonance frequency.

16. The antenna apparatus according to claim 15, wherein at least one variable capacitance element is connected to said free terminal of the chip antenna.

17. The antenna apparatus according to claim 16, wherein one of said variable capacitance elements is connected to said free terminal of the chip antenna at the final stage of said plurality of chip antennas which are connected to each other in series.

18. The antenna apparatus according to claim 15, wherein a radiation conductor is connected to said free terminal of the chip antenna at the final stage.

19. The antenna apparatus according to claim 15, wherein a capacitance element is connected between at least one of the connection points of said free terminal and said power feeding terminal, and a ground.

20. The antenna apparatus according to claim 13, wherein a switching element is connected in series to said capacitance element.

21. The antenna apparatus according to claim 15, wherein a coaxial cable is connected to the power feeding terminal of the chip antenna at the first stage of said plurality of chip antennas which are connected to each other in series.

* * * * *